US009309465B2

(12) United States Patent
Kozuru et al.

(10) Patent No.: US 9,309,465 B2
(45) Date of Patent: Apr. 12, 2016

(54) COAL REFORMING METHOD AND COAL REFORMING APPARATUS

(71) Applicants: NIPPON STEEL & SUMITOMO METAL CORPORATION, Tokyo (JP); NIPPON STEEL & SUMIKIN ENGINEERING CO., LTD., Tokyo (JP)

(72) Inventors: Hiroyuki Kozuru, Tokyo (JP); Akira Kanei, Tokyo (JP); Katsuyuki Tomita, Tokyo (JP); Katsushi Kosuge, Tokyo (JP); Atsushi Kobayashi, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 14/415,107

(22) PCT Filed: Jul. 19, 2013

(86) PCT No.: PCT/JP2013/069671

§ 371 (c)(1),
(2) Date: Jan. 15, 2015

(87) PCT Pub. No.: WO2014/014092

PCT Pub. Date: Jan. 23, 2014

(65) Prior Publication Data

US 2015/0175891 A1 Jun. 25, 2015

(30) Foreign Application Priority Data

Jul. 20, 2012 (JP) ..... 2012-162080
Jul. 20, 2012 (JP) ..... 2012-162081

(51) Int. Cl.
*C10B 57/10* (2006.01)
*C10B 57/08* (2006.01)
(Continued)

(52) U.S. Cl.
CPC ..... *C10B 57/10* (2013.01); *C10B 21/00* (2013.01); *C10B 53/04* (2013.01); *C10B 57/08* (2013.01);
(Continued)

(58) Field of Classification Search
CPC ..... C10B 57/10; C10B 53/04; C10B 21/00; C10L 9/08; C10L 2290/08
See application file for complete search history.

(56) References Cited

U.S. PATENT DOCUMENTS 3,384,557 A * 5/1968 Saller ..... 44/598
3,574,065 A 4/1971 Eddinger et al.
(Continued)

FOREIGN PATENT DOCUMENTS

CN 101760222 A 6/2010
JP 61136586 A * 6/1986 ..... C10B 3/00
(Continued)

OTHER PUBLICATIONS

Australian Office Action, dated Feb. 20, 2015, for Australian Application No. 2013291057.
(Continued)

*Primary Examiner* — In Suk Bullock
*Assistant Examiner* — Jonathan Miller
(74) *Attorney, Agent, or Firm* — Birch, Stewart, Kolasch & Birch, LLP

(57) ABSTRACT

A coal reforming method includes: drying; performing carbonizing; and cooling. (1) In the drying, coal is classified into coarse coal and fine coal while being dried, and heat obtained by burning at least a portion of the fine coal and at least a portion of the carbonizing gas is used as a heat source during the drying or the carbonizing. (2) In the cooling, the char is classified while being cooled to separate fine char from the char, and heat obtained by burning at least a portion of the fine char and at least a portion of the carbonizing gas is used as a heat source during the drying or the carbonizing. At least any one of (1) and (2) is performed.

32 Claims, 9 Drawing Sheets

(51) Int. Cl.

| | |
|---|---|
| ***C10L 9/08*** | (2006.01) |
| ***F26B 3/08*** | (2006.01) |
| ***F26B 17/10*** | (2006.01) |
| ***F26B 23/02*** | (2006.01) |
| ***C10B 21/00*** | (2006.01) |
| ***C10B 53/04*** | (2006.01) |
| *C10B 47/30* | (2006.01) |

(52) U.S. Cl.

CPC ... *C10L 9/08* (2013.01); *F26B 3/08* (2013.01); *F26B 17/10* (2013.01); *F26B 23/028* (2013.01); *C10B 47/30* (2013.01); *C10L 2290/06* (2013.01); *C10L 2290/08* (2013.01); *C10L 2290/546* (2013.01)

(56) References Cited

U.S. PATENT DOCUMENTS

| | | | | |
|---|---|---|---|---|
| 4,002,533 | A | 1/1977 | Repik et al. | |
| 6,453,830 | B1 * | 9/2002 | Zauderer | 110/345 |
| 7,987,613 | B2 * | 8/2011 | Ness et al. | 34/138 |
| 2013/0239479 | A1 * | 9/2013 | Gao et al. | 48/89 |

FOREIGN PATENT DOCUMENTS

| | | | | | |
|---|---|---|---|---|---|
| JP | 5-065487 | A | | 3/1993 | |
| JP | 10-287882 | A | | 10/1998 | |
| JP | 11-181443 | A | | 7/1999 | |
| JP | 2003183670 | A | * | 7/2003 | C10B 57/10 |
| JP | 2005-036078 | A | | 2/2005 | |
| JP | 2005-319374 | A | | 11/2005 | |
| JP | 2008-138021 | A | | 6/2008 | |
| JP | 5597778 | B2 | | 10/2014 | |

OTHER PUBLICATIONS

International Search Report issued in PCT/JP2013/069671, mailed on Oct. 22, 2013.

Notice of Allowance issued in Japanese Patent Application No. 2013-556711, mailed on Jul. 15, 2014.

Office Action issued in Japanese Patent Application No. 2013-556711, mailed on Apr. 22, 2014.

Written Opinion issued in PCT/JP2013/069671, mailed on Oct. 22, 2013.

Chinese Office Action dated Nov. 13, 2015, issued in Chinese Patent Application No. 201380047992.7.

* cited by examiner

COAL REFORMING METHOD AND COAL REFORMING APPARATUS

TECHNICAL FIELD OF THE INVENTION

The present invention relates to a coal reforming method and a coal reforming apparatus.

Priority is claimed on Japanese Patent Application No. 2012-162080, filed on Jul. 20, 2012 and Japanese Patent Application No. 2012-162081, filed on Jul. 20, 2012, the contents of which are incorporated herein by reference.

RELATED ART

Carbides are manufactured by reforming a raw material containing carbon through drying and carbonizing the raw material, and the manufactured carbides are used as fuels.

For example, in Patent Document 1 as follows, a technique is disclosed in which sludge is used as the raw material containing carbon, the sludge is dried in a drying furnace and is thereafter treated in a carbonization furnace (that is, a carbonizing furnace), thereby being converted into fuel. In addition, in Patent Document 1 as follows, that the supplying of heat needed for drying and carbonizing by burning the sludge, an auxiliary fuel, and the obtained carbides and volatile components is described.

PRIOR ART DOCUMENT

Patent Document

[Patent Document 1] Japanese Unexamined Patent Application, First Publication No. 2005-319374

DISCLOSURE OF THE INVENTION

Problems to be Solved by the Invention

However, when char is manufactured by using coal as the raw material containing carbon and by reforming the coal, in a case of using the method described in Patent Document 1 described above, using volatile components generated during the carbonizing as a heat source for the heat needed for the drying and the carbonizing has been examined.

In this case, when coal having a high moisture content (for example, 15% or higher) is used as the raw material containing carbon, a huge amount of heat is needed for the drying and the carbonizing, and thus the supply of a fuel from an outside source is necessary. Oil which can be used as an external fuel is expensive, and thus using coal as the external fuel is considered. In a case where some coal which is a raw material for manufacturing char is used as the external fuel, in consideration of prevention of dust emission from char generated in a coal reforming treatment, relatively coarse coal is used as coal for the raw material, and only fine particles of coal are used as the external fuel. However, in this case, an additional classifying process needs to be provided.

Furthermore, in a case where coal in which the moisture content is not high is used as the raw material containing carbon, volatile components except for volatile components needed for the drying and the carbonizing may be used to make products such as fuel gas or chemical raw materials. However, there is a problem in that most of the generated volatile components are used for the drying and the carbonizing and thus only a small amount of volatile components can be used to make products.

As described above, in the case where coal is used as the external fuel, a pretreatment for the coal is inevitable when the moisture content of the coal is high. On the other hand, the amount of volatile components that can be recovered as products is reduced when the moisture content of the coal is not high. Accordingly, there is a problem in that the coal cannot be efficiently reformed.

Here, the present invention has been made taking the forgoing circumstances into consideration, and an object of the present invention is to provide a coal reforming method and a coal reforming apparatus capable of reforming coal more efficiently even in a case where components derived from coal are used as external fuels for a reforming treatment.

Means for Solving the Problem

As a result of the examination by the inventors, when char is manufactured by reforming coal, in a case where coal having a low degree of carbonization such as subbituminous coal or lignite is used, it is known that the following problems are present. That is, coal such as subbituminous coal or lignite has a high content of a hydrophilic functional group such as a hydroxyl group in the components of the coal, thus water is likely to be accumulated in the pores of the coal, resulting in a high moisture content. Regarding the coal having a high moisture content, in a case where using combustion heat of volatile components generated from the coal is used as a heat source for drying and carbonizing is postulated, it becomes apparent that there are cases where a heating value needed for the drying and the carbonizing cannot be provided only by the combustion heat of the volatile components.

Therefore, the inventors have intensively examined a method in which when various components such as coal or volatile components generated from coal are used as a heat source, the coal can be more efficiently reformed without a new pretreatment even in a case where the coal in use is coal having a high moisture content.

As a result, it was thought that a necessary heating value for drying and carbonizing can be secured by using a fluidized bed drying and classifying device for drying coal injected into an apparatus, recovering fine coal from gas containing the fine coal discharged from the fluidized bed drying and classifying device, and using the recovered fine coal as a heat source without the addition of a new pretreatment, which leads to the present invention.

In addition, by using such a method, it was seen that in a case of using coal in which the moisture content is not high, the amount of gas, tar, and the like which can be recovered as products can be increased.

The summary of embodiments of the present invention is as follows.

(1) A coal reforming method according to an embodiment of the present invention includes: classifying coal into coarse coal and fine coal while drying the coal in a fluidized bed drying and classifying device; performing carbonizing on the coarse coal by a carbonizing device to be reformed into carbonizing gas and char; and supplying heat obtained by supplying at least a portion of the fine coal and at least a portion of the carbonizing gas to a combustor and burning the portions, to at least any one of the fluidized bed drying and classifying device and the carbonizing device as a heat source.

(2) The coal reforming method described in (1) may further include: mixing at least a portion of flue gas discharged from the fluidized bed drying and classifying device with combustion gas supplied from the combustor to at least any one of the fluidized bed drying and classifying device and the carbonizing device.

(3) The coal reforming method described in (1) or (2) may further include: supplying at least a portion of the fine coal obtained by the fluidized bed drying and classifying device to the carbonizing device.

(4) In the coal reforming method described in (3), the fine coal supplied to the carbonizing device may be supplied to the carbonizing device after being formed singly or together with the coarse coal.

(5) In the coal reforming method described in any one of (1) to (4), the carbonizing device may be of an indirect heating type which is supplied with heating gas from an outside source, and the coal reforming method may further include supplying the heating gas discharged from the carbonizing device to the fluidized bed drying and classifying device.

(6) The coal reforming method described in any one of (1) to (5) may further include: mixing at least a portion of flue gas discharged from the fluidized bed drying and classifying device with heating gas supplied to the fluidized bed drying and classifying device.

(7) In the coal reforming method described in any one of (1) to (6), instead of the carbonizing gas among the fine coal and the carbonizing gas which are supplied to the combustor, an external fuel may be used.

(8) A coal reforming apparatus according to another embodiment of the present invention includes: a fluidized bed drying and classifying device which classifies coal into coarse coal and fine coal while drying the coal; a carbonizing device which performs carbonizing on the dried coarse coal to be reformed into carbonizing gas and char; and a combustor which is supplied with at least a portion of the carbonizing gas and the fine coal and supplies heat obtained by burning the carbonizing gas and the fine coal to at least any one of the fluidized bed drying and classifying device and the carbonizing device as a heat source.

(9) The coal reforming apparatus described in (8) may be configured so that at least a portion of flue gas discharged from the fluidized bed drying and classifying device is mixed with combustion gas supplied from the combustor to at least any one of the fluidized bed drying and classifying device and the carbonizing device as the heat source.

(10) The coal reforming apparatus described in (8) or (9) may be configured so that at least a portion of the fine coal obtained by the fluidized bed drying and classifying device is supplied to the carbonizing device.

(11) The coal reforming apparatus described in (10) may further include a forming machine which forms the fine coal singly or together with the coarse coal and may be configured so that at least a portion of the fine coal obtained by the fluidized bed drying and classifying device is supplied to the carbonizing device after being formed singly or together with the coarse coal by the forming machine.

(12) In the coal reforming apparatus described in any one of (8) to (11), the carbonizing device may be of an indirect heating type which is supplied with heating gas from an outside source, and a configuration in which the heating gas discharged from the carbonizing device is supplied to the fluidized bed drying and classifying device may be employed.

(13) The coal reforming apparatus described in any one of (8) to (12) may employ a configuration in which at least a portion of flue gas discharged from the fluidized bed drying and classifying device is mixed with heating gas supplied to the fluidized bed drying and classifying device as the heat source.

(14) In the coal reforming apparatus described in any one of (8) to (13), instead of the carbonizing gas among the fine coal and the carbonizing gas which are supplied to the combustor, an external fuel may be used.

As a result of the above-described examination by the inventors, it was postulated that a necessary heating value for drying and carbonizing can be maintained without performing a pretreatment by using a fluidized bed cooling and classifying device to cool the char generated by the carbonizing, recovering fine char from gas that is discharged from the fluidized bed cooling and classifying device and contains the fine char, and using the recovered fine char as a heat source.

Since the above-described method is used, in a case of using coal in which the moisture content is not high, the amount of gas, tar, and the like which can be recovered as products can be increased.

The summary of other embodiments of the present invention based on the above description is as follows.

(15) A coal reforming method according to another aspect of the present invention includes: drying coal by a dryer; performing carbonizing on the dried coal by the carbonizing device to be reformed into carbonizing gas and char; classifying the char while cooling the char by a fluidized bed cooling and classifying device to separate fine char from the char; and supplying heat obtained by supplying at least a portion of the fine char and the carbonizing gas to a combustor and burning the portions, to at least any one of the dryer and the carbonizing device as a heat source.

(16) The coal reforming method described in (15) may further include: supplying flue gas discharged from at least any one of the dryer and the fluidized bed cooling and classifying device to the fluidized bed cooling and classifying device as cooling gas.

(17) The coal reforming method described in (15) or (16) may further include: mixing at least a portion of flue gas discharged from the dryer with combustion gas supplied from the combustor to at least any one of the dryer and the carbonizing device.

(18) In the coal reforming method described in any one of (15) to (17), the carbonizing device may be of an indirect heating type which is supplied with heating gas from an outside source, and the coal reforming method may further include supplying the heating gas discharged from the carbonizing device to the dryer.

(19) The coal reforming method described in any one of (15) to (18) may further include: classifying the coal into coarse coal and fine coal while drying the coal by using a fluidized bed drying and classifying device as the dryer, in the drying of the coal by the dryer; and supplying the fine coal to the combustor.

(20) The coal reforming method described in (19) may further include: mixing at least a portion of flue gas discharged from the fluidized bed drying and classifying device with heating gas supplied to the fluidized bed drying and classifying device as the heat source.

(21) The coal reforming method described in (19) or (20) may further include: supplying at least a portion of the fine coal obtained by the fluidized bed drying and classifying device to the carbonizing device.

(22) In the coal reforming method described in (21), at least a portion of the fine coal obtained by the fluidized bed drying and classifying device may be supplied to the carbonizing device after being formed singly or together with the coarse coal.

(23) In the coal reforming method described in any one of (15) to (22), instead of the carbonizing gas among the fine char and the carbonizing gas which are supplied to the combustor, an external fuel may be used.

(24) A coal reforming apparatus according to another aspect of the present invention, includes: a dryer which dries coal; a carbonizing device which performs carbonizing on the dried coal to be reformed into carbonizing gas and char; a fluidized bed cooling and classifying device which classifies the char while cooling the char to separate the fine char from the char; and a combustor which is supplied with at least a portion of the fine char and the carbonizing gas and supplies heat obtained by burning the carbonizing gas and the fine char to at least any one of the dryer and the carbonizing device as a heat source.

(25) In the coal reforming apparatus described in (24), flue gas discharged from at least any one of the dryer and the fluidized bed cooling and classifying device may be supplied to the fluidized bed cooling and classifying device as cooling gas.

(26) The coal reforming apparatus described in (24) or (25) may be configured so that at least a portion of flue gas discharged from the dryer is mixed with combustion gas supplied from the combustor to at least any one of the dryer and the carbonizing device as the heat source.

(27) In the coal reforming apparatus described in any one of (24) to (26), the carbonizing device may be of an indirect heating type which is supplied with heating gas from an outside source, and a configuration in which the heating gas discharged from the carbonizing device is supplied to the dryer may be employed.

(28) The coal reforming apparatus described in any one of (24) to (27) may employ a configuration in which the dryer is a fluidized bed drying and classifying device which classifies the coal into coarse coal and fine coal while drying the coal, and the fine coal is supplied to the combustor.

(29) The coal reforming apparatus described in (28) may be configured so that at least a portion of flue gas discharged from the fluidized bed drying and classifying device is mixed with heating gas supplied to the fluidized bed drying and classifying device as the heat source.

(30) The coal reforming apparatus described in (28) or (29) may employ a configuration in which at least a portion of the fine coal obtained by the fluidized bed drying and classifying device is supplied to the carbonizing device.

(31) The coal reforming apparatus described in (30) may further include a forming machine which forms the fine coal singly or together with the coarse coal, and may employ a configuration in which at least a portion of the fine coal obtained by the fluidized bed drying and classifying device is supplied to the carbonizing device after being formed singly or together with the coarse coal by the forming machine.

(32) In the coal reforming apparatus described in any one of (24) to (31), instead of the carbonizing gas among the fine char and the carbonizing gas which are supplied to the combustor, an external fuel may be used.

Effects of the Invention

According to the embodiments (1) to (14) of the above descriptions, the fluidized bed drying and classifying device is used as the dryer which is used to reform the coal, and the fine coal obtained by the fluidized bed drying and classifying device is used as the fuel. Accordingly, the coal can be reformed more efficiently.

According to the aspects (15) to (32) of the above descriptions, the fluidized bed cooling and classifying device is used as the cooler used to reform the coal, and the fine char obtained by the fluidized bed cooling and classifying device is used as the fuel. Accordingly, the coal can be reformed more efficiently.

EMBODIMENTS OF THE INVENTION

Figure 1:
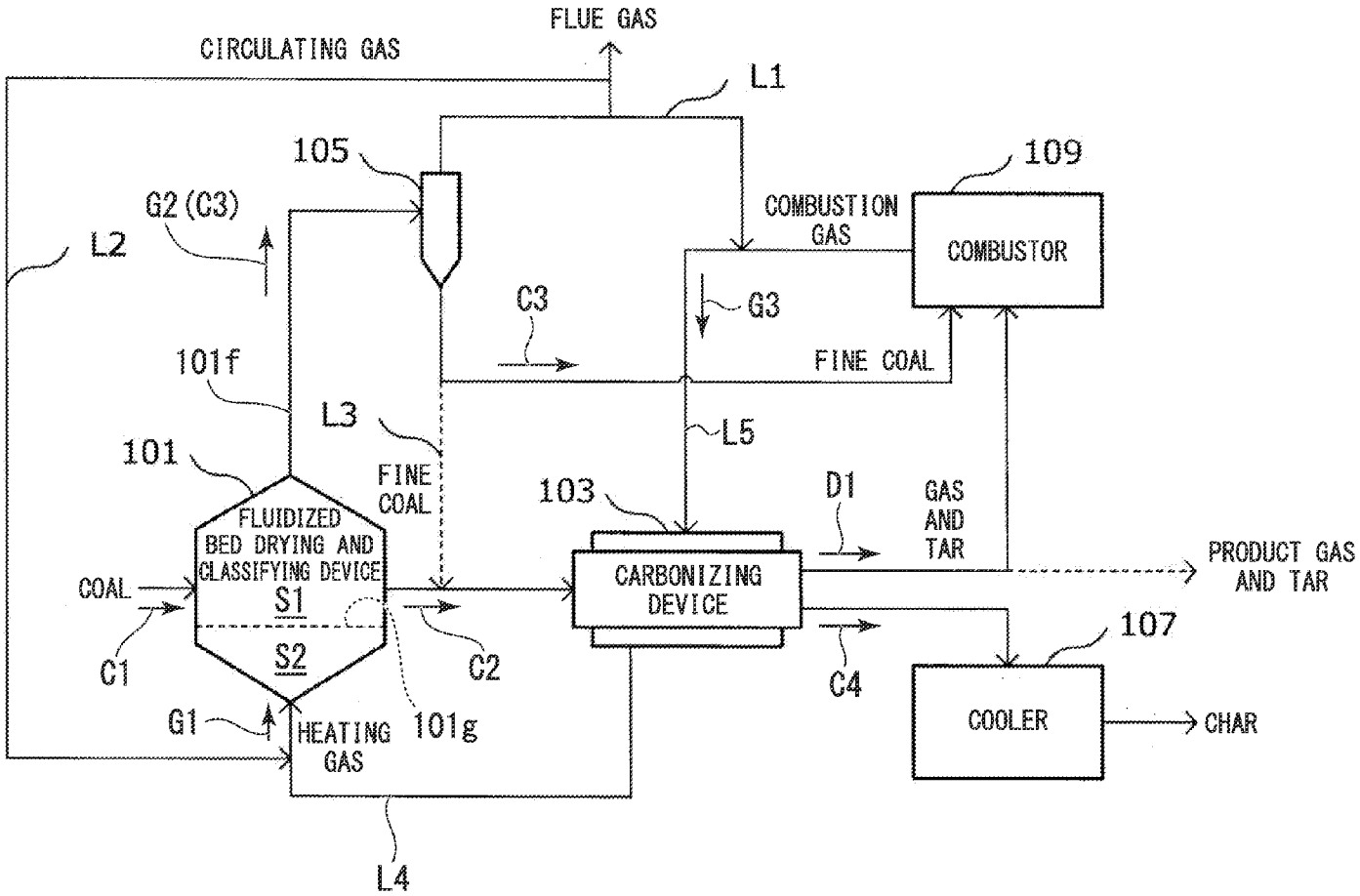
FIG. 1 is a process flowchart illustrating the configuration of a coal reforming apparatus according to a first embodiment of the present invention.

Hereinafter, exemplary embodiments of the present invention will be described in detail with reference to the accompanying drawings. In the description and the drawings, like elements having substantially the same functional configurations are denoted by like reference numerals, and overlapped description thereof will be omitted.

First Embodiment

Figure 2:
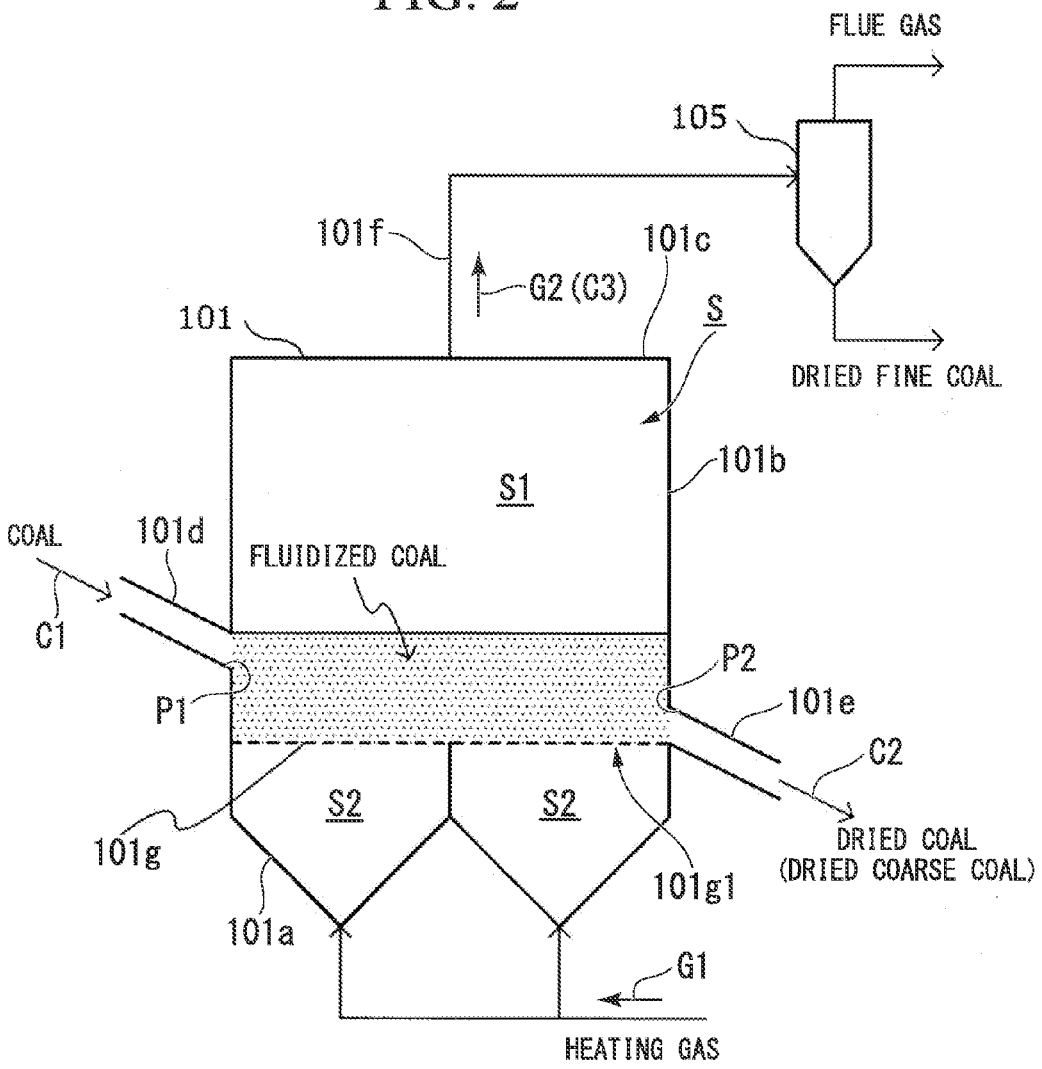
FIG. 2 is a longitudinal cross-sectional view illustrating a fluidized bed drying and classifying device of the coal reforming apparatus.
Figure 3:
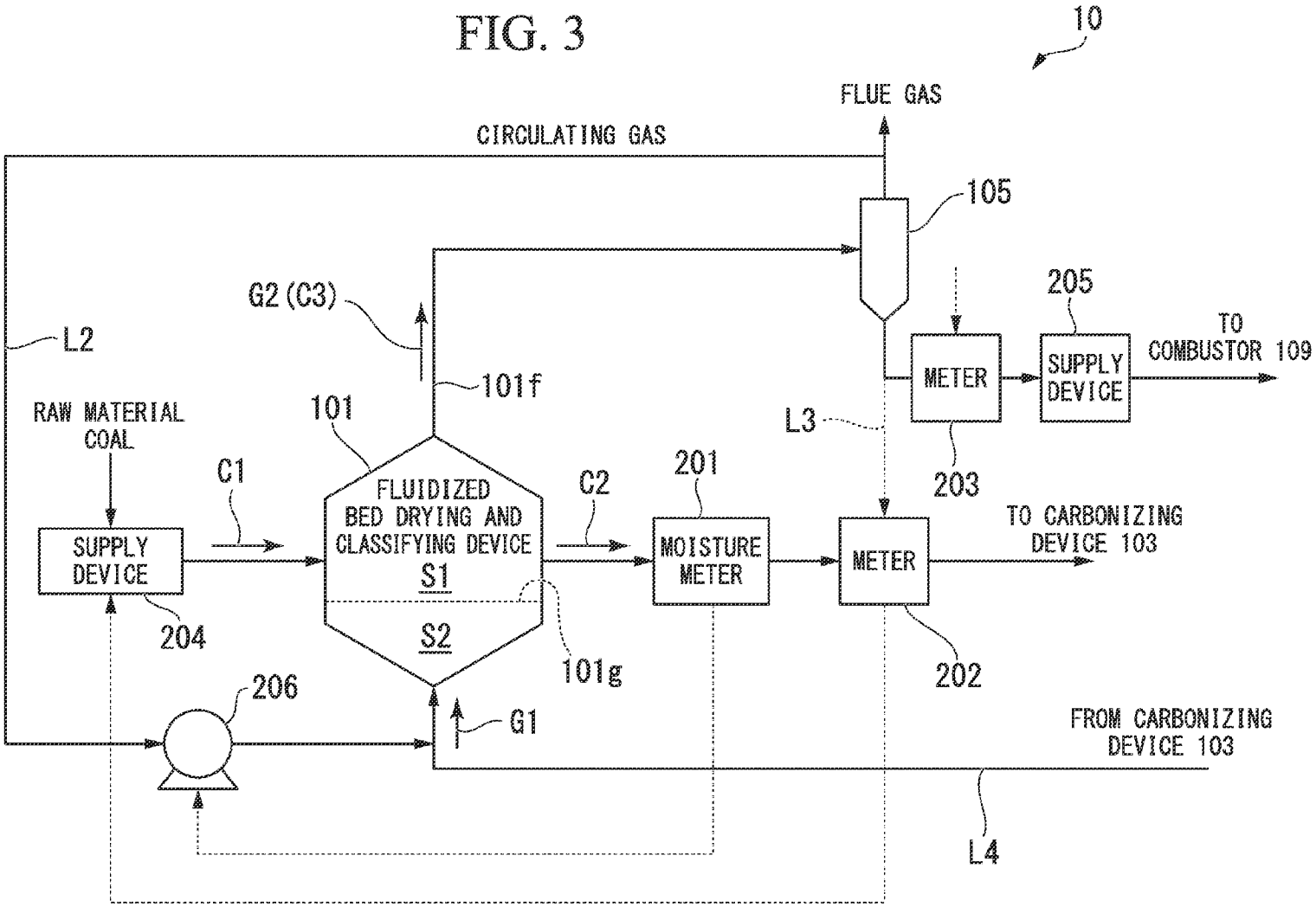
FIG. 3 is a view illustrating an example of automatic control in the coal reforming apparatus, and is an explanatory view illustrating a part of FIG. 1.

Hereinafter, the configuration of a coal reforming apparatus according to a first embodiment of the present invention will be described in detail with reference to FIGS. 1 to 3. FIG. 1 is a process flowchart illustrating the configuration of the coal reforming apparatus according to this embodiment, and FIG. 2 is a longitudinal cross-sectional view illustrating a fluidized bed drying and classifying device of the coal reforming apparatus according to this embodiment. FIG. 3 is a view illustrating an example of automatic control in the coal reforming apparatus according to this embodiment, and is an explanatory view illustrating a part of FIG. 1.

Hereinafter, a coal reforming apparatus 10 according to this embodiment will be described with reference to FIGS. 1 and 2. The coal reforming apparatus 10 according to this embodiment is an apparatus which is supplied with coal having a particle size distribution (in other words, coal which is not subjected to an agglomeration treatment such as briquetting in advance) and performs drying and carbonizing on the supplied coal to reform the coal, thereby manufacturing char.

As illustrated in FIG. 1, the coal reforming apparatus 10 according to this embodiment mainly includes a fluidized bed drying and classifying device 101, a carbonizing device 103, a dust collector 105, a cooler 107, and a combustor 109.

A dryer is a device which heats the coal having a particle size distribution that is supplied to the coal reforming apparatus 10 to remove moisture contained in the coal, thereby drying the coal to have a predetermined moisture content. In the coal reforming apparatus 10 according to this embodiment, as illustrated in FIGS. 1 and 2, the fluidized bed drying and classifying device 101 is used as the dryer.

Hot gas of, for example, about 300° C. which is discharged from the carbonizing device 103 is supplied to the fluidized bed drying and classifying device 101 as heating gas G1.

As illustrated in FIG. 2, the fluidized bed drying and classifying device 101 includes a bottom wall 101*a*, a side wall 101*b*, and an upper wall 101*c* which constitute a container that forms an internal space S, a coal injection pipe 101*d* and a dried coal discharge pipe 101*e* which are provided in the side wall 101*b*, a heating gas discharge pipe 101*f* which is provided in the upper wall 101*c*, and a distributor 101*g* which is disposed in the internal space S.

In a case where the fluidized bed drying and classifying device 101 is viewed in a plan view along the circumferential direction thereof, the coal injection pipe 101*d* and the dried coal discharge pipe 101*e* are provided at opposite positions to each other. In other words, for example, when viewed in the longitudinal cross-sectional view of FIG. 2, the coal injection pipe 101*d* is connected to the left side of the side wall 101*b* in the figure, and the dried coal discharge pipe 101*e* is connected to the right side in the figure which is the opposite side. Furthermore, when viewed along the vertical direction, the position of a connection port P1 between the coal injection pipe 101*d* and the side wall 101*b* is higher than the position of a connection port P2 between the dried coal discharge pipe 101*e* and the side wall 101*b*.

As described above, in the internal space S of the fluidized bed drying and classifying device 101, as illustrated in the longitudinal cross-sectional view of FIG. 2, in order to fluidize the injected coal C1, the distributor 101*g* in which a number of small through-holes 101*g*1 are formed to allow the heating gas G1 to flow upward in the vertical direction is provided. The distributor 101*g* is horizontally disposed at substantially the same position as that of the lower end of the connection port P2. The circumferential edge of the distributor 101*g* is fixed to the inner circumferential surface of the side wall 101*b*, and the lower surface thereof is supported at an upper position of the bottom wall 101*a*. As a result, the internal space S is partitioned by the distributor 101*g* into a drying and classifying chamber S1 which dries and classifies the injected coal C1, and a heating gas supply chamber S2 which is provided immediately below the drying and classifying chamber S1 and receives the heating gas introduced from the bottom wall 101*a*.

The heating gas G1 supplied from the bottom wall 101*a*, that is the bottom portion of the container included in the fluidized bed drying and classifying device 101, passes upward through the through-holes 101*g*1 provided in the distributor 101*g* from the heating gas supply chamber S2, flows into the drying and classifying chamber S1 which is the upper portion in the container, and is discharged from the heating gas discharge pipe 101*f* which is a discharge portion provided in the upper wall 101*c* on the upper side of the container.

The coal C1 having a particle size distribution is fed onto the distributor 101*g*, and is fluidized and heated by the heating gas G1 which is blown upward from the heating gas supply chamber S2 that is the lower part of the container. More specifically, first, the coal C1 is continuously injected into the drying and classifying chamber S1 through the connection port P1 via the coal injection pipe 101*d*, and is stacked on the distributor 101*g*. In addition, the heating gas G1 supplied into the heating gas supply chamber S2 passes upward through the through-holes 101*g*1 from the lower side of the distributor 101*g*. The heating gas G1 fed into the drying and classifying chamber S1 as such is blown upward from the lower layer of the coal C1 stacked on the distributor 101*g* to the upper layer thereof. In this procedure, due to the blown heating gas G1, the coal C1 is fluidized by wind pressure, and is simultaneously dried through heating. Therefore, in the fluidized bed drying and classifying device 101 according to this embodiment, the heating gas G1 supplied from the lower side of the container functions as heating and drying gas, and also functions as fluidizing gas.

The coal C1 in the drying and classifying chamber S1 is fluidized by the heating gas G1 supplied into the drying and classifying chamber S1 of the fluidized bed drying and classifying device 101 and is heated by the heating gas G1 such that moisture contained therein is removed. Here, in the fluidized bed drying and classifying device 101, the atmospheric temperature in the drying and classifying chamber S1 is maintained at about 100° C. by the supplied heating gas G1, and the supplied coal C1 is heated so that the temperature of the coal C1 at the outlet of the fluidized bed drying and classifying device 101 is about several tens of ° C. to 100° C. (preferably, for example, about 80° C. to 100° C.). Accordingly, moisture contained in the supplied coal C1 is removed. In a case where the temperature of the coal C1 at the outlet of the fluidized bed drying and classifying device 101 is less than a temperature lower limit (for example, less than 80° C.) which is permitted on the facility design, there is a possibility that moisture may remain in the dried coal C2 at a content equal to or higher than a predetermined target value, which is not preferable. Even in a case where the temperature of the coal C1 at the outlet of the fluidized bed drying and classifying device 101 is much higher than 100° C., there is a possibility that carbonizing the coal C1 may be started, which is not preferable.

The internal temperature of the drying and classifying chamber S1 may be controlled according to, for example, the flow rate and the like of the heating gas G1 supplied to the fluidized bed drying and classifying device 101. In addition, the moisture content of the coal C1 at the outlet of the fluidized bed drying and classifying device 101 may be appropriately set according to the target value of the moisture content in the dried coal C2 supplied to the carbonizing device 103 at a later stage, predetermined operation regulations, and the like.

The heating gas G1 is supplied to the drying and classifying chamber S1 such that the coal C1 on the distributor 101*g* is fluidized. As a result, fine coal C3 contained in the coal C1, which has a particle size (the particle size is a particle size based on the premise of sieving, and is equivalent to a minor axis, of which the following applies the same) of, for example, about 0.3 mm to 0.5 mm, rides on the heating gas G1 that flows upward in the drying and classifying chamber S1 and is discharged from the upper portion of the fluidized bed drying and classifying device 101. In addition, the moisture of coarse coal which is coal having a greater particle size than the fine coal is removed to finally be a predetermined moisture content (for example, a moisture content of 10% or the like). Thereafter, the coarse coal is discharged from the connection port P2 which is a discharge port provided in the vicinity of the distributor 101*g* of the fluidized bed drying and classifying device 101 and is transported to the carbonizing device 103 provided at the later stage.

Heating gas G2 containing the fine coal C3 which is discharged from the fluidized bed drying and classifying device 101 is introduced to the dust collector 105, which will be described later, as illustrated in FIGS. 1 and 2.

As described above, in the drying and classifying chamber S1 in the fluidized bed drying and classifying device 101 according to this embodiment, the coal C1 containing moisture is dried, and simultaneously, a classification treatment of the coal C1 is performed by using the heating gas (fluidizing gas) G1. By the classification treatment, the fine coal having a predetermined particle size (fine coal C3 having a particle size of equal to or less than a predetermined classification point, with a small amount of incorporated coal which is greater than the predetermined classification point) is removed. Therefore, the ratio of the fine coal incorporated into the dried coal (more specifically, the coarse coal after being dried) C2 supplied to the carbonizing device 103 can be reduced. As a result, a calibration problem caused by the incorporation of the fine coal into carbonizing gas (including tar) D1 which is generated in and discharged from the carbonizing device 103 is more easily reduced, and thus clogging and the like of pipes through which the carbonizing gas D1 flows can be more effectively suppressed or prevented. By using the dried coal (that is, coarse coal) C2 from which the fine coal C3 is removed, the ratio of fine particles contained in char C4 that is recovered as a product can be reduced, thereby efficiently reducing dust emission from the char C4.

The amount of the fine coal C3 obtained by the fluidized bed drying and classifying device 101 is determined by the initial particle size distribution of the coal C1 injected into the fluidized bed drying and classifying device 101 or the flow rate of the heating gas G1 which is the fluidizing gas in the fluidized bed drying and classifying device 101. The classification point in the fluidized bed drying and classifying device 101, that is, a target particle size by which the coal C1 having the particle size distribution is classified into the fine coal C3 and the coarse coal (dried coal C2) can be adjusted by the flow rate of the fluidizing gas, and the amount of the fine coal C3 discharged from the upper portion of the fluidized bed drying and classifying device 101 can be changed by changing the settings of the classification point through the adjustment.

In a case where the internal temperature in the classifying drying and chamber S1 in the fluidized bed drying and classifying device 101 is controlled to be higher than 100° C., a boiler (not illustrated) may be additionally provided at an intermediate position of a pipe L4 which supplies the heating gas G1 from the carbonizing device 103 to the fluidized bed drying and classifying device 101 so that high temperature steam generated in the boiler may be used as the heating gas G1.

The carbonizing device 103 is a device which receives the dried coal (dried coarse coal) C2 which is dried by the fluidized bed drying and classifying device 101 to have a predetermined moisture content and performs carbonizing on the received dried coarse coal. As the carbonizing device 103 according to this embodiment, a direct heating type carbonizing device such as a circulating fluidized bed or an internal heating type rotary kiln may be used, but an indirect heating type carbonizing device such as an external heating type rotary kiln is preferably used. By using the indirect heating type carbonizing device such as an external heating type rotary kiln, mixing of the heating gas used for the carbonizing of the dried coal C2 with the carbonizing gas containing volatile components generated by the carbonizing of the dried coal C2 can be prevented, and thus the heating value of the carbonizing gas (including a tar component) can be maintained at a high level.

The carbonizing device 103 is supplied with combustion gas G3 generated by burning substances in the combustor 109, which will be described later, as the heating gas, and allows the carbonizing of the dried coal C2 through heating by the supplied combustion gas G3, thereby generating the carbonizing gas D1 such as gas or tar and the char C4.

During the carbonizing of the dried coal C2, the atmospheric temperature in the carbonizing device 103 becomes about 400° C. to 1200° C. although depending on carbonizing conditions. In a case where the atmospheric temperature in the carbonizing device 103 is less than 400° C., a thermal decomposition reaction of the dried coal C2 does not proceed, and it is difficult to generate the carbonizing gas D1 or the char C4. In a case where the atmospheric temperature in the carbonizing device 103 is higher than 1200° C., the thermal decomposition reaction of the dried coal C2 is finished, and thus the discharge of the volatile components is also finished. Therefore, there is a possibility that thermal efficiency of the entire coal reforming apparatus 10 may be reduced.

In a case where the indirect heating type carbonizing device such as an external heating type rotary kiln is used as the carbonizing device 103, it is preferable that the atmospheric temperature in the carbonizing device 103 be equal to or less than 900° C. according to the relationships between structures, materials, and the like.

The char C4 generated in the carbonizing device 103 has a high temperature of about 600° C. although depending on the carbonizing conditions, and is thus transported to the cooler 107, which will be described later, so as to be cooled. In addition, as the char C4 is generated, the carbonizing gas D1 (including tar (a component which becomes a liquid at room temperature) or various types of gases (components that are in a gaseous state even at room temperature) mainly containing hydrocarbons such as carbon monoxide (CO), hydrogen ($H_2$), and methane ($CH_4$)) is generated. At least a portion of the generated carbonizing gas D1 is supplied to the combustor 109, which will be described later, and is used as a heat source for heat used in the coal reforming apparatus 10. In addition, a portion of the carbonizing gas D1 can be recovered as a product (product gas or tar).

The dust collector 105 is a device which separates the fine coal C3 contained in the flue gas G2 discharged from the fluidized bed drying and classifying device 101 from gas components. As the dust collector 105 according to this embodiment, for example, a cyclone, a bag filter, or the like can be used. The fine coal (dried fine coal) C3 separated by the dust collector 105 is transported to the combustor 109, which will be described later. The gas from which the fine coal C3 is removed is discharged to the outside of the system of the coal reforming apparatus 10 as flue gas.

Furthermore, in a case where the amount of the dried coal C2 transported from the fluidized bed drying and classifying device 101 to the carbonizing device 103 is small, or in a case where the moisture content of the dried coal C2 at the outlet of the fluidized bed drying and classifying device 101 is equal to or less than a predetermined value, a portion of the fine coal C3 recovered by the dust collector 105 may be supplied to the carbonizing device 103 by using a pipe L3 illustrated in FIG. 1. Accordingly, operations can be optimized by increasing the amount of the dried coal C2 supplied to the carbonizing device 103, increasing the moisture content of the dried coal C2 to a predetermined amount, and the like.

At this time, by using a forming machine, which is not illustrated, such as a molding machine or a granulator, the fine coal C3 may be molded or granulated singly or together with the dried coal C2 before being supplied to the carbonizing device 103. In addition, "mold" and "granulate" mentioned here belong to "form" mentioned in the present invention. This point is also applied to other embodiments or modification examples in the same manner.

More specifically describing molding or granulating, the molding machine or the granulator is installed on the pipe L3, and the dried coal C2 taken out from the fluidized bed drying and classifying device 101 is molded by the molding machine or granulated by the granulator. Thereafter, the result may be added to the dried coal C2 transported from the fluidized bed drying and classifying device 101 to the carbonizing device 103 to be supplied to the carbonizing device 103.

By forming the fine coal C3 into a molded material or a granulated material in advance, dust emission in the carbonizing device 103 can be suppressed, and the amount of fine char which scatters along with the carbonizing gas D1 can be reduced, thereby increasing the recovery rate of the generated char C4. The molding can be performed by compression molding, extrusion forming, or the like, and the granulating can be performed by rolling granulation or the like. At this time, in order to improve moldability or granulation properties, a binder such as tar or cement may be added to the fine coal C3. Regarding the size of the molded material or the granulated material, in terms of the suppression of dust emission and prevention of scattering, it is preferable that the diameter (equivalent to a minor axis in a case where the shape is not spherical) of the material be equal to or higher than about several millimeters. Although the upper limit is not particularly limited, in consideration of easiness of molding, granulating, and handling and easiness of heat transfer into the char C4 obtained after the carbonizing, it is preferable that the diameter (the diameter is a diameter based on the premise of sieving and is equivalent to a minor axis) be equal to or less than several tens of millimeters. The size of the molded material or the granulated material is also influenced by the performance of the molding machine or the granulator, and is generally about several centimeters to 10 cm, for example, in a case of briquette molding.

In the above description, a case where flue gas discharged from the carbonizing device 103 is supplied to the fluidized bed drying and classifying device 101 via the pipe L4 as both the heating gas and the fluidizing gas is described. At this time, a configuration in which the combustion gas G3 discharged from the combustor 109, which will be described later, is cooled by the flue gas supplied from the dust collector 105 via a pipe L1 as necessary and thereafter is directly supplied to the fluidized bed drying and classifying device 101, not to the carbonizing device 103, may also be employed (not illustrated). In the case where the combustion gas G3 discharged from the combustor 109 is used, the carbonizing temperature of the carbonizing device 103 can be easily controlled by adjusting the amount of the flue gas added from the pipe L1, which is more preferable.

In the above description, the case where the flue gas discharged from the carbonizing device 103 is supplied to the fluidized bed drying and classifying device 101 as both the heating gas and the fluidizing gas (heating gas G1) is described. Instead of this, at least a portion of the flue gas discharged from the dust collector 105 may be added to and mixed with the heating gas G1 as circulating gas by using a pipe L2 illustrated in FIG. 1, and the mixture may be supplied to the fluidized bed drying and classifying device 101. By mixing the flue gas discharged from the dust collector 105 with the heating gas G1 supplied to the fluidized bed drying and classifying device 101, the flow rate or temperature of the heating gas G1 supplied to the fluidized bed drying and classifying device 101 can be adjusted, thereby more efficiently operating the coal reforming apparatus 10.

The cooler 107 is a device which cools the char C4 generated in the carbonizing device 103 to a temperature at which handling is facilitated. A well-known cooler can be used in the coal reforming apparatus 10 according to this embodiment. For example, as the cooler, an indirect cooling type cooler such as a rotary kiln, a direct cooling type cooler which applies water spraying, a fluidized bed cooler, and the like may be used.

The combustor 109 is a device which generates heat used in the coal reforming apparatus 10 according to this embodiment. At least a portion of the carbonizing gas D1 generated in the carbonizing device 103 and the fine coal (dried fine coal) C3 recovered by the dust collector 105 are supplied to the combustor 109 as fuel. The combustor 109 burns the carbonizing gas D1 and the fine coal C3 to generate the combustion gas G3 having a high temperature of, for example, about 1000° C. to 1500° C. The combustion gas G3 is introduced to the carbonizing device 103 and is used as a heat source for the thermal decomposition reaction in the carbonizing device 103.

Although not illustrated in the figures, as the combustor 109, a combustor for burning the carbonizing gas D1 and a combustor for burning the fine coal C3 may be separately provided. However, it is preferable to use a common combustor in which a burner (for example, a fine coal injection pipe and the like) that injects the fine coal C3 into a combustion space of the combustor for burning the carbonizing gas D1 is provided.

By using the combustor for burning the carbonizing gas D1 and the combustor for burning the fine coal C3 in common, the fine coal C3 can be injected into a high temperature field where the carbonizing gas D1 is burned, and thus the fine coal C3 can be easily burned.

In addition, as another embodiment, in a case where an indirect heating type carbonizing device such as an external heating type rotary kiln to which heating gas is supplied from an outside source is used as the carbonizing device 103 and the heating gas discharged from the carbonizing device 103 is supplied to the fluidized bed drying and classifying device 101, the carbonizing device 103 may double as the combustor 109 by using an external heat portion (the outer circumferential portion in the external heating type rotary kiln) as a combustion space.

Here, depending on the carbonizing conditions of the carbonizing device 103, there may be cases where the temperature of the combustion gas G3 at about 1000° C. to 1500° C. discharged from the combustor 109 is too high. At this time, it is preferable that by using the pipe L1 illustrated in FIG. 1, the flue gas from the dust collector 105 be mixed with the combustion gas from the combustor 109 to reduce the temperature of the combustion gas G3. Since the temperature of the flue gas from the dust collector 105 is about 100° C. and thus is lower than the temperature of the combustion gas G3 from the combustor 109, the temperature of the combustion gas G3 from the combustor 109 can be adjusted to be an appropriate temperature by mixing the flue gas with the combustion gas G3. In a case where the flue gas from the dust collector 105 is not mixed with the combustion gas G3, a heat exchanger, which is not illustrated, such as a boiler may be provided at an intermediate position of a pipe L5 which supplies the combustion gas G3 from the combustor 109 to the carbonizing device 103 to reduce the temperature of the combustion gas G3.

Hereinbefore, the coal reforming apparatus 10 according to this embodiment has been described in detail with reference to FIGS. 1 and 2.

In the related art, in a case where coal having a high moisture content is used as a raw material, even when carbonizing gas generated in a carbonizing device is used, there may be cases where heat needed for drying coal and carbonizing coal is not provided. On the other hand, in a coal reforming method using the coal reforming apparatus 10 according to this embodiment, the fluidized bed drying and classifying device 101 is used as a dryer, and the fine coal C3 generated in the fluidized bed drying and classifying device 101 is introduced to the combustor 109. Accordingly, even in the case where the coal having a high moisture content is used, a necessary heating value for the drying and the carbonizing can be provided without the supply of other fuels from an outside source.

In addition, in a case where coal in which the moisture content is not high is used, a heat source for drying and carbonizing the coal can be provided by burning the generated carbonizing gas. However, in the coal reforming method using the coal reforming apparatus 10 according to this embodiment, by introducing the dried fine coal C3 obtained by the fluidized bed drying and classifying device 101 to the combustor 109 to be burned, the amount of the carbonizing gas D1 supplied to the combustor 109 can be reduced. As a result, the amount of gas or tar recovered as a product can be increased.

The amount of the dried fine coal C3 obtained by the fluidized bed drying and classifying device 101 is determined by the particle size distribution of the coal C1 injected into the coal reforming apparatus 10 or by the flow rate of the heating gas G1 supplied to the fluidized bed drying and classifying device 101 as described above. However, in a case where the moisture content of the coal C1 is high and the moisture content of the dried coal C2 at the outlet of the fluidized bed drying and classifying device 101 is high, the flow rate of the heating gas G1 which is the fluidizing gas supplied to the fluidized bed drying and classifying device 101 is increased and the supply amount of the dried fine coal C3 transported to the combustor 109 is increased to increase the combustion amount in the combustor 109, thereby generating a necessary heating value.

In a case where the moisture content of the dried coal C2 at the outlet of the fluidized bed drying and classifying device 101 is low, the supply amount of the dried fine coal C3 transported to the combustor 109 is reduced by reducing the flow rate of the heating gas G1 which is the fluidizing gas or the dried fine coal C3 is returned to the carbonizing device 103 via the pipe L3 illustrated in FIG. 1, thereby adjusting the amount or the moisture content of the dried coal C2 supplied to the carbonizing device 103. At this time, as described above, the dried fine coal C3 may be formed singly or together with the dried coal C2 before being supplied to the carbonizing device 103. As such, in this embodiment, even in a case where the moisture content of the coal C1 changes, the balance in the heating value of the entire coal reforming apparatus 10 can be controlled.

In order to adjust the amount of the dried fine coal C3 recovered in the dust collector 105, for example, the flue gas discharged from the dust collector 105 is supplied to the fluidized bed drying and classifying device 101 as the circulating gas by using the pipe L2 illustrated in FIG. 1, and the flow rate of the heating gas G1 is increased or reduced by increasing or reducing the supply amount to adjust the flow rate of the fluidizing gas, thereby increasing or reducing the amount of the dried fine coal C3. In this case, even when the circulating gas supplied from the pipe L2 is mixed and thus the temperature decreases, the heating gas G1 is supplemented by increasing the flow rate of the heating gas G1 supplied from the carbonizing device 103 so that the heating gas G1 can maintain a desired heating value.

In addition, identifying the moisture content of the dried coal C2 on the output side of the fluidized bed drying and classifying device 101, controlling the amount of the fine coal C3 introduced from the dust collector 105, and controlling the flow rate of the fluidizing gas (heating gas G1) supplied to the fluidized bed drying and classifying device 101 may be manually performed by an operator of the coal reforming apparatus 10, or may be automatically performed by various controllers (not illustrated) provided in the coal reforming apparatus 10.

MODIFICATION EXAMPLE

A modification example of a case of employing the automatic control by the controllers will be described with reference to FIG. 3.

In this modification example, the coal reforming apparatus 10 further employs a configuration in which a moisture meter 201 and a meter 202 which are provided in a pipe from the output side of the fluidized bed drying and classifying device 101 to the input side of the carbonizing device 103, a meter 203 which is provided in a pipe from the dust collector 105 to the combustor 109, and the controllers are provided. In FIG. 3, in addition to the additional devices, a supply device 204 which cuts the coal C1 and transports the result to the fluidized bed drying and classifying device 101, a supply device 205 which supplies the fine coal C3 from the dust collector 105 to the combustor 109, and a pump 206 which returns the flue gas (circulating gas) to the fluidized bed drying and classifying device 101 from the dust collector 105 are illustrated. However, these are also provided in the coal reforming apparatus 10, and the illustration thereof is omitted from FIG. 1.

According to the above-described configuration, first, the following automatic control is performed when the coal reforming method described with reference to the coal reforming apparatus 10 is applied.

That is, the supply amount of the dried coal C2 directed from the fluidized bed drying and classifying device 101 to the carbonizing device 103 is measured by the meter 202, and is identified by the controllers. The controllers increase or decrease the supply amount of the cut coal C1 supplied from the supply device 204 to the fluidized bed drying and classifying device 101 to allow the supply amount to be constant.

The moisture content of the dried coal C2 at the outlet of the fluidized bed drying and classifying device 101 is measured by the moisture meter 201, and is identified by the controllers. The controllers control the pump 206 to allow the moisture content to be in a desired range.

That is, in a case where the controllers determine that the moisture content is higher than the desired range, the number of revolutions of the pump 206 is increased. Therefore, the flow rate of the flue gas (circulating gas) flowing through the pipe L2 is increased, and the flow rate of the heating gas G1 supplied to the fluidized bed drying and classifying device 101 is increased.

Consequently, the flow rate of the flue gas G2 which is generated in the fluidized bed drying and classifying device 101 and contains the fine coal C3 is increased, and thus the amount of the fine coal C3 obtained by the dust collector 105 is also increased. While the supply amount of the fine coal C3 directed from the dust collector 105 to the combustor 109 is measured by the meter 203, the supply amount of the fine coal C3 supplied by the supply device 205 is increased to a desired supply amount.

Consequently, the heating value of the combustion gas G3 generated in the combustor 109 is increased, and thus the heating value of the heating gas G1 supplied to the fluidized bed drying and classifying device 101 via the pipe L5 and the pipe L4 is increased. As a result, the heating value added to the coal C1 injected into the fluidized bed drying and classifying device 101 is increased, and thus the coal C1 can be further dried, thereby reducing the moisture content of the dried coal C2.

In contrast, when the controllers determines that the moisture content is lower than the desired range, the supply amount of the fine coal C3 directed to the combustor 109 by the supply device 205 is measured by the meter 203 to be reduced, and the remaining fine coal C3 is supplied to the carbonizing device 103 via the pipe L3.

As another method, the flow rate of the flue gas (circulating gas) flowing through the pipe L2 may be reduced by reducing the number of revolutions of the pump 206 so that the flow rate of the heating gas G1 supplied to the fluidized bed drying and classifying device 101 is reduced. As a result, the supply amount of the fine coal C3 supplied to the combustor 109 may be reduced. In this case, since the heating value of the combustion gas G3 generated in the combustor 109 is reduced, the heating value added to the coal C1 injected into the fluidized bed drying and classifying device 101 is also reduced. Therefore, the dried coal C2 can be allowed to have a more appropriate moisture content and the heating value used for heating the coal C1 can be saved. As a matter of course, this control may be combined with the above-described control to return the remaining fine coal C3 to the carbonizing device 103 via the pipe L3.

In the first embodiment described above, the method and the apparatus for efficiently reforming the coal C1 without the supply of fuels from an outside source are described. However, in a case where external fuels can be obtained at a relatively low cost, as another embodiment of the present invention, heating gas may be manufactured by using the external fuels to perform carbonizing, and carbonizing gas generated as a result may be recovered as a product.

For example, in an environment in which gas that has a low heating value and needs low cost (for example, blast furnace gas (BFG) generated in the steel industry) can be acquired, the gas is burned in the combustor 109, the generated combustion gas is used in the carbonizing device 103 as the heating gas, and the generated carbonizing gas having a high heating value may also be recovered as a product. Even in this case, since the fine coal C3 is burned in the combustor 109, calibration caused by the incorporation of the fine coal into the carbonizing gas D1 can also be reduced while operations are performed relatively efficiently.

In addition, in a case where the external fuels are used as described above, the carbonizing gas D1 may be separated into gas and tar to be recovered, the tar may further be decomposed to be recovered, or the gas or the tar may be reformed to be recovered.

Examples

Subsequently, while describing Examples 1 to 3 and Comparative Example 1, the coal reforming apparatus 10 according to the embodiment of the present invention will be described in more detail. In addition, Examples 1 to 3 described as follows are only examples, and the coal reforming apparatus of the present invention is not construed as being limited only to Examples 1 to 3 described as follows.

In Examples 1 to 3 and Comparative Example 1 described as follows, coal having a particle size distribution illustrated in the following Table 1 was used as a raw material. In addition, the particle size is a particle size based on the premise of sieving and is equivalent to a minor axis.

[Table 1]

TABLE 1

| Particle size distribution of coal | |
|---|---|
| Particle size | Distribution [mass %] |
| 5 mm or greater | 0.0 |
| 3 to 5 mm | 1.0 |
| 1 to 3 mm | 33.0 |
| 0.5 to 1 mm | 35.8 |
| 0.25 to 0.5 mm | 17.6 |
| Less than 0.25 mm | 12.6 |
| Total | 100.0 |

Example 1

The coal C1 (having a moisture content of 60%) which was coarsely crushed and had the particle size distribution illustrated in Table 1 was injected into the fluidized bed drying and classifying device 101 at 600 kg/h (240 kg/h excluding moisture), and was dried in the fluidized bed drying and classifying device 101 by using the heating gas G1 at 350° C. and 2600 $Nm^3/h$ until the moisture content became 10%. The obtained dried coal C2 was injected into the carbonizing device 103 which was the external heating type rotary kiln, and the temperature thereof was increased to 600° C. for carbonizing.

As a result, char at 130 kg/h, gas (gas that mainly contained CO, $H_2$, and $CH_4$ and had a heating value of 3450 kcal/$Nm^3$) at 65 $Nm^3/h$, and tar at 18 kg/h could be obtained, and the obtained total amount (the total amount of the gas and the tar generated in the carbonizing device 103 excluding a product char) was transported to the combustor 109 and was burned to obtain the combustion gas G3 at 1500° C. The dried fine coal C3 at 15 kg/h recovered by the fluidized bed drying and classifying device 101 was simultaneously burned in the combustor 109. In Example 1, the heating gas G1 was cooled by being mixed with the flue gas from the dust collector 105 by using the pipe L1 illustrated in FIG. 1.

Example 2

The coal C1 (having a moisture content of 65%) which was coarsely crushed and had the particle size distribution illustrated in Table 1 was injected into the fluidized bed drying and classifying device 101 at 690 kg/h (240 kg/h excluding moisture), and was dried in the fluidized bed drying and classifying device 101 by using the heating gas G1 at 320° C. and 2800 $Nm^3/h$ until the moisture content became 10%. During the drying treatment, the flue gas discharged from the dust collector 105 was mixed with the heating gas G1 by using the pipe L2 illustrated in FIG. 1, and the flow rate of the heating gas G1 was increased finally to 200 $Nm^3/h$. The temperature of the obtained dried coal C2 was increased to 600° C. in the carbonizing device 103 which was the external heating type rotary kiln for carbonizing. As a result, char at 125 kg/h, gas (gas that mainly contained CO, $H_2$, and $CH_4$ and had a heating value of 3450 kcal/$Nm^3$) at 62 $Nm^3/h$, and tar at 17 kg/h could be obtained, and the obtained total amount was transported to the combustor 109 and was burned to obtain the combustion gas at 1500° C. The dried fine coal C2 at 25 kg/h recovered by the fluidized bed drying and classifying device 101 was simultaneously burned in the combustor 109. In Example 2, the heating gas G1 was cooled by being mixed with the flue gas from the dust collector 105 by using the pipe L1 illustrated in FIG. 1. When the inside of the pipe from the carbonizing device 103 to the combustor 109 was inspected after the operation, dust adhesion had rarely occurred, and carryover had rarely occurred.

Example 3

The coal C1 (having a moisture content of 57%) which was coarsely crushed and had the particle size distribution illustrated in Table 1 was injected into the fluidized bed drying and classifying device 101 at 560 kg/h (240 kg/h excluding moisture), and was dried in the fluidized bed drying and classifying device 101 by using the heating gas G1 at 310° C. and 2600 $Nm^3/h$ until the moisture content became 10%. The temperature of the obtained dried coal C2 was increased to 600° C. in the carbonizing device 103 which was the external heating type rotary kiln for carbonizing. As a result, char at 134 kg/h, gas (gas that mainly contained CO, $H_2$, and $CH_4$ and had a heating value of 3450 kcal/$Nm^3$) at 67 $Nm^3/h$, and tar at 18.7 kg/h could be obtained, and the obtained total amount (the total amount of the gas and the tar generated in the carbonizing device 103 excluding a product char) was transported to the combustor 109 and was burned to obtain the combustion gas G3 at 1500° C. The dried fine coal C3 at 6 kg/h among the dried fine coal C3 at 15 kg/h recovered by the fluidized bed drying and classifying device 101 was simultaneously burned in the combustor 109. The remaining dried fine coal C3 at 9 kg/h was subjected to compression molding by the molding machine, which is not illustrated in FIG. 1, provided in the pipe L3 of FIG. 1, and the result was then injected into the carbonizing device 103. As a result, it was confirmed that the recovery amount (recovery rate) of the char was increased, the amount of fine particles in the recovered char was smaller than that in Comparative Example, and the amount of dust emitted from the char was small. In Example 3, similarly to Example 1, the heating gas G1 was cooled by being mixed with the flue gas from the dust collector 105 by using the pipe L1 illustrated in FIG. 1.

Comparative Example 1

Coal (having a moisture content of 60%) which was coarsely crushed and had the particle size distribution illustrated in Table 1 was injected into a band dryer at 600 kg/h. In addition, the coal was dried in the band dryer by using gas at 350° C. and 2600 $Nm^3/h$ until the moisture content became 10%. The temperature of the obtained dried coal was increased to 600° C. in a carbonizing device which is an external heating type rotary kiln for carbonizing. As a result, char at 139 kg/h, gas (gas that mainly contained CO, $H_2$, and $CH_4$ and had a heating value of 3450 kcal/$Nm^3$) at 69 $Nm^3/h$, and tar at 19 kg/h could be obtained, and the obtained total amount was transported to a combustor and was burned to be combustion gas at 1500° C.

In this case, a necessary heating value for the dryer and the carbonizing device could not be provided, and thus heavy oil at 9 kg/h was supplied to the combustor and was burned to secure a necessary heating value for treatments. As described above, in a case where dried fine coal from the fluidized bed drying and classifying device was not used, heavy oil at 9 kg/h was needed. When the inside of the pipe from the carbonizing device to the combustor was inspected after the operation, it was seen that dust adhesion had occurred (particularly significantly in bent portions), and carryover had occurred. Therefore, there is concern that the pipe may be clogged during an operation over a long period of time.

While the embodiments and the modification examples of the present invention have been described above, the gist thereof is collected as follows.

(1) The coal reforming method according to the embodiment includes: classifying the coal C1 into the coarse coal that is the dried coal C2, and the fine coal C3 while drying the coal C1 in the fluidized bed drying and classifying device 101; performing the carbonizing on the coarse coal using the carbonizing device 103 to be reformed into the carbonizing gas D1 and the char C4; and supplying the heat obtained by supplying at least a portion of the fine coal C3 and at least a portion of the carbonizing gas D1 to the combustor 109 and burning the portions, to at least any one of the fluidized bed drying and classifying device 101 and the carbonizing device 103 as the heat source.

(2) The coal reforming method described in (1) may further include: mixing at least a portion of the flue gas G2 discharged from the fluidized bed drying and classifying device 101 with the combustion gas G3 supplied from the combustor 109 to at least any one of the fluidized bed drying and classifying device 101 and the carbonizing device 103.

(3) The coal reforming method described in (1) or (2) may further include: supplying at least a portion of the fine coal C3 obtained by the fluidized bed drying and classifying device 101 to the carbonizing device 103.

(4) In the coal reforming method described in (3), the fine coal C3 supplied to the carbonizing device 103 may be supplied to the carbonizing device 103 after being formed singly or together with the coarse coal.

(5) In the coal reforming method described in any one of (1) to (4), the carbonizing device 103 may be of an indirect heating type which is supplied with the heating gas from an outside source, and supplying the heating gas G1 discharged from the carbonizing device 103 to the fluidized bed drying and classifying device 101 may be further included.

(6) The coal reforming method described in any one of (1) to (5) may further include: mixing at least a portion of the flue gas G2 discharged from the fluidized bed drying and classifying device 101 with the heating gas G1 supplied to the fluidized bed drying and classifying device 101.

(7) In the coal reforming method described in any one of (1) to (6), instead of the carbonizing gas D1 among the fine coal C3 and the carbonizing gas D1 which are supplied to the combustor 109, the external fuel may be used.

(8) The coal reforming apparatus according to the embodiment includes: the fluidized bed drying and classifying device 101 which classifies the coal C1 into the coarse coal that is the dried coal C2, and the fine coal C3 while drying the coal C1; the carbonizing device 103 which performs the carbonizing on the dried coarse coal to be reformed into the carbonizing gas D1 and the char C4; and the combustor 109 which is supplied with at least a portion of the carbonizing gas D1 and the fine coal C3 and supplies the heat obtained by burning the carbonizing gas D1 and the fine coal C3 to at least any one of the fluidized bed drying and classifying device 101 and the carbonizing device 103 as the heat source.

(9) The coal reforming apparatus described in (8) may be configured so that at least a portion of the flue gas G2 discharged from the fluidized bed drying and classifying device 101 is mixed with the heating gas G1, which is the combustion gas supplied as the heat source from the combustor 109 to at least any one of the fluidized bed drying and classifying device 101 and the carbonizing device 103.

(10) The coal reforming apparatus described in (8) or (9) may be configured so that at least a portion of the fine coal C3 obtained by the fluidized bed drying and classifying device 101 is supplied to the carbonizing device 103.

(11) The coal reforming apparatus described in (10) may further include the forming machine which forms the fine coal C3 singly or together with the dried coal C2, and may be configured so that at least a portion of the fine coal C3 obtained by the fluidized bed drying and classifying device 101 is supplied to the carbonizing device 103 after being formed singly or together with the dried coal C2 by the forming machine.

(12) In the coal reforming apparatus described in any one of (8) to (11), the carbonizing device 103 may be of an indirect heating type which is supplied with the heating gas from an outside source, and a configuration in which the heating gas G1 discharged from the carbonizing device 103 is supplied to the fluidized bed drying and classifying device 101 may be employed.

(13) The coal reforming apparatus described in any one of (8) to (12) may employ a configuration in which at least a portion of the flue gas G2 discharged from the fluidized bed drying and classifying device 101 is mixed with the heating gas G1 supplied to the fluidized bed drying and classifying device 101 as the heat source.

(14) In the coal reforming apparatus described in any one of (8) to (13), instead of the carbonizing gas D1 among the fine coal C3 and the carbonizing gas D1 which are supplied to the combustor 109, the external fuel may be used.

As described above, according to this embodiment, the fluidized bed drying and classifying device 101 is employed as the dryer used to reform the coal C1, and the fine coal C3 obtained by the fluidized bed drying and classifying device 101 is used as the fuel. Accordingly, the reformation of the coal C1 can be more efficiently performed.

While the first embodiment has been described in detail with reference to the accompanying drawings, the present invention is not limited only to the embodiment. It is apparent that various modification examples or correction examples can be made by those skilled who have knowledge in the technical field to which the present invention belongs, without departing from the technical spirit described in the appended claims, and it is understood that the examples naturally belong to the technical scope of the present invention.

Hereinafter, other embodiments of the present invention will be described in detail with reference to the accompanying drawings. In the following description and the drawings, like elements having substantially the same functional configurations as those described in the first embodiment are denoted by like reference numerals, and overlapped description thereof will be omitted.

(Second Embodiment)

Figure 4:
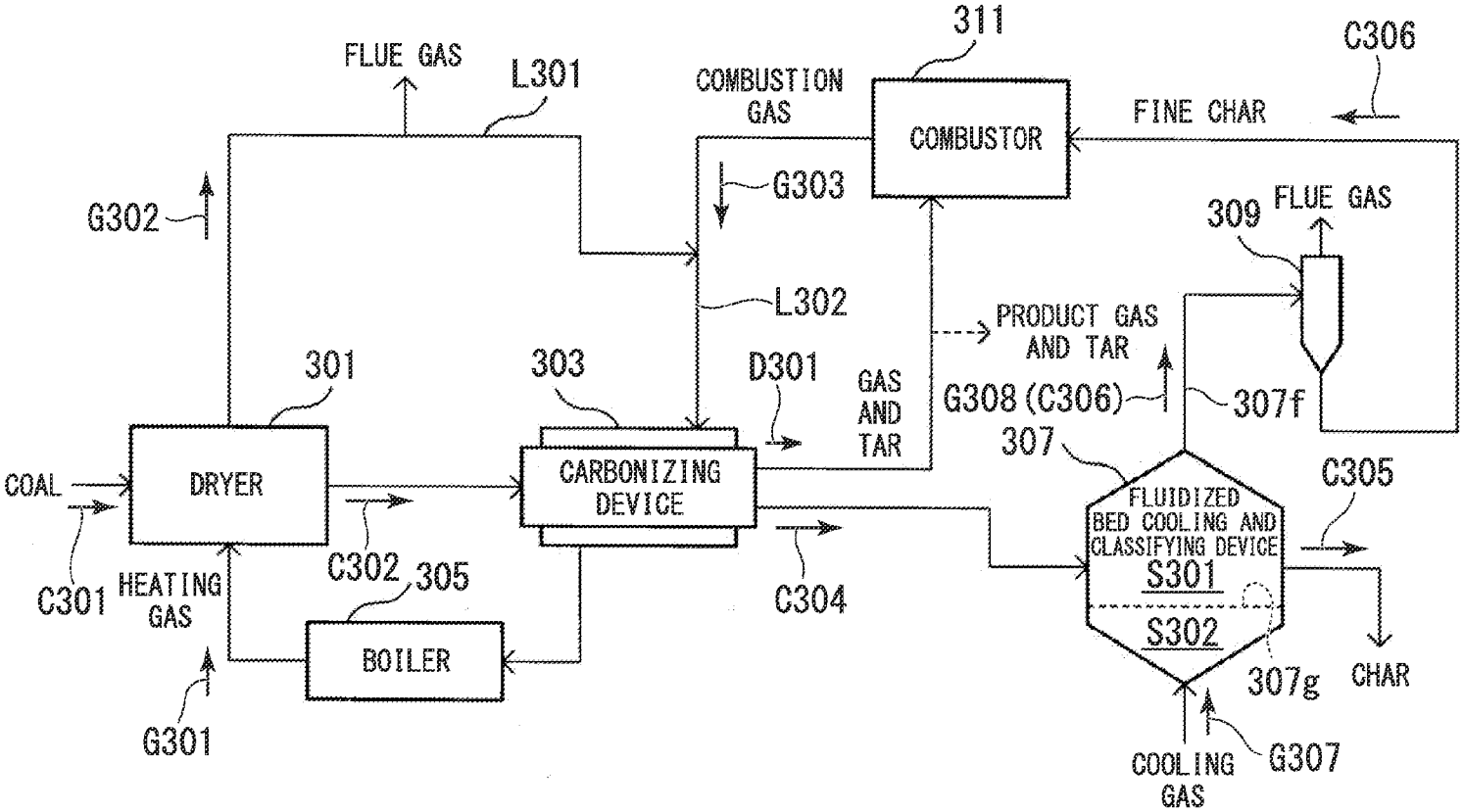
FIG. 4 is a process flowchart illustrating the configuration of a coal reforming apparatus according to a second embodiment of the present invention.
Figure 5:
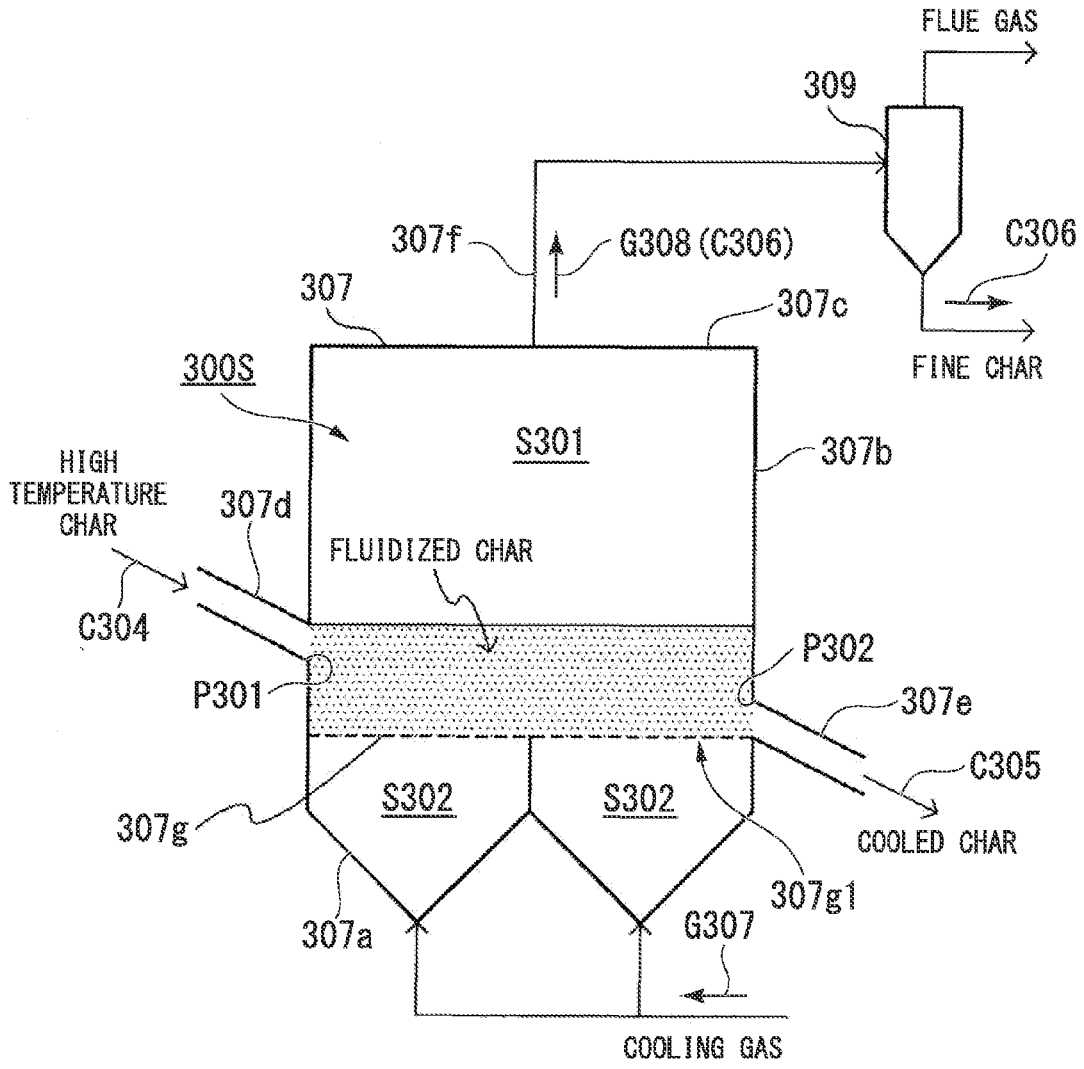
FIG. 5 is a longitudinal cross-sectional view illustrating a fluidized bed cooling and classifying device of the coal reforming apparatus.

Hereinafter, the configuration of a coal reforming apparatus according to a second embodiment of the present invention will be described in detail with reference to FIGS. 4 and 5. FIG. 4 is a process flowchart illustrating the configuration of the coal reforming apparatus 310 according to this embodiment, and FIG. 5 is a longitudinal cross-sectional view illustrating a fluidized bed cooling and classifying device 307 of the coal reforming apparatus 310 according to this embodiment.

Hereinafter, the coal reforming apparatus 310 according to this embodiment will be described with reference to FIGS. 4 and 5. The coal reforming apparatus 310 according to this embodiment is an apparatus which is supplied with coal C301 having a particle size distribution (in other words, coal which is not subjected to an agglomeration treatment such as briquetting in advance) and performs drying and carbonizing on the supplied coal C301 to reform the coal C301, thereby manufacturing char.

As illustrated in FIG. 4, the coal reforming apparatus 310 according to this embodiment mainly includes a dryer 301, a carbonizing device 303, a boiler 305, the fluidized bed cooling and classifying device 307, a dust collector 309, and a combustor 311.

The dryer 301 is a device which heats the coal C301 having a particle size distribution that is supplied to the coal reforming apparatus 310 to remove moisture contained in the coal C301, thereby drying the coal C301 to have a predetermined moisture content. It is preferable that an indirect heating type dryer be used as the dryer 301 according to this embodiment. As the indirect heating type dryer, for example, a tube dryer such as a steam tube dryer (STD) or a coal-in-tube (CIT) dryer may be employed. By using the indirect heating type dryer, heating gas G301 for heating the coal C301 can be prevented from being mixed with gas generated in the dryer 301, and thus the heating value of the heating gas G301 can be maintained.

Steam which is generated in the boiler 305 by using, for example, hot gas of about 300° C. discharged from the carbonizing device 303, which will be described later, is supplied to the dryer 301 as the heating gas G301. Otherwise, the high temperature gas discharged from the carbonizing device 303 may be directly supplied to the dryer 301 as the heating gas G301, not via the boiler 305.

In the dryer 301, the internal atmospheric temperature is maintained at about 100° C. by the supplied heating gas, and the supplied coal C301 is heated so that the temperature of dried coal C302 at the outlet of the dryer 301 is about several tens of ° C. to 100° C. (preferably, for example, about 80° C. to 100° C.). Accordingly, moisture contained in the supplied coal C301 is removed. In a case where the temperature of the dried coal C302 at the outlet of the dryer 301 is less than a temperature lower limit (for example, less than 80° C.) which is permitted on the facility design, there is a possibility that moisture may remain in the dried coal C302 at a content equal to or higher than a predetermined target value, which is not preferable. In addition, in a case where the temperature of the dried coal C302 at the outlet of the dryer 301 is much higher than 100° C., there is a possibility that carbonizing the dried coal C302 may be started, which is not preferable.

The internal temperature of the dryer 301 may be controlled by adjusting, for example, the flow rate and the like of the heating gas G301 supplied to the dryer 301. In addition, the moisture content of the dried coal C302 at the output side of the dryer 301 may be appropriately set according to the target value of the moisture content in the dried coal C302 supplied to the carbonizing device 303 at a later stage, predetermined operation regulations, and the like.

The dried coal C302 from which moisture is removed by the dryer 301 to achieve a predetermined moisture content (for example, a moisture content of 10% or the like) is transported to the carbonizing device 303 provided at the later stage. Heating gas G302 discharged from the dryer 301 is treated as flue gas. However, for example, by using a pipe L301 illustrated in FIG. 4, at least a portion of the heating gas G302 may be mixed with combustion gas G303 supplied from the combustor 311, which will be described later, to the carbonizing device 303. In this case, the carbonizing temperature of the carbonizing device 303 can be easily controlled by adjusting the amount of the flue gas from the pipe L301, which is more preferable.

The carbonizing device 303 is a device which receives the dried coal C302 that is coal dried by the dryer 301 to have a predetermined moisture content and performs carbonizing on the received dried coal C302. As the carbonizing device 303 according to this embodiment, a direct heating type carbonizing device such as a circulating fluidized bed or an internal heating type rotary kiln may be used, but an indirect heating type carbonizing device such as an external heating type rotary kiln is preferably used. By using the indirect heating type carbonizing device such as an external heating type rotary kiln, mixing of the heating gas used for the carbonizing of the dried coal C302 with carbonizing gas D301 containing volatile components generated by the carbonizing of the dried coal C302 can be prevented, and thus the heating value of the carbonizing gas D301 (including a tar component) can be maintained at a high level.

The carbonizing device 303 is supplied with combustion gas G303 generated by burning substances in the combustor 311, which will be described later, as the heating gas, and allows the carbonizing of the dried coal C302 by the supplied combustion gas G303, thereby generating the carbonizing gas D301 such as gas or tar and char C304.

During the carbonizing of the dried coal C302, the atmospheric temperature in the carbonizing device 303 becomes about 400° C. to 1200° C. although depending on carbonizing conditions. In a case where the atmospheric temperature in the carbonizing device 303 is less than 400° C., a thermal decomposition reaction of the dried coal C302 does not proceed, and it is difficult to generate the carbonizing gas D301 or the char C304. In a case where the atmospheric temperature in the carbonizing device 303 is higher than 1200° C., the thermal decomposition reaction of the dried coal C302 is finished, and thus the discharge of the volatile components is also finished. Therefore, there is a possibility that thermal efficiency of the entire coal reforming apparatus 310 may be reduced. In a case where the indirect heating type carbonizing device such as an external heating type rotary kiln is used as the carbonizing device 303, it is preferable that the atmospheric temperature in the carbonizing device 303 be equal to or less than 900° C. according to the relationships between structures, materials, and the like.

The char C304 generated in the carbonizing device 303 has a high temperature of about 600° C. although depending on the carbonizing conditions, and is thus transported to the cooler 307, which will be described later, so as to be cooled. In addition, as the char C304 is generated, the carbonizing gas D301 (including tar (a component which becomes a liquid at room temperature) or various types of gases (components that are in a gaseous state even at room temperature) mainly containing hydrocarbons such as carbon monoxide (CO), hydrogen ($H_2$), and methane ($CH_4$)) is generated. At least a portion of the generated carbonizing gas D301 is supplied to the combustor 311, which will be described later, to be burned, and is used as a heat source for heat used in the coal reforming apparatus 310. In addition, a portion of the carbonizing gas D301 can be recovered as a product.

The cooler 307 is a device which cools the char C304 generated in the carbonizing device 303 to a temperature at which handling is facilitated. In the coal reforming apparatus 310 according to this embodiment, as illustrated in FIGS. 4 and 5, a fluidized bed cooling and classifying device (hereinafter, referred to as the fluidized bed cooling and classifying device 307) is used as the cooler 307.

As illustrated in FIG. 5, the fluidized bed cooling and classifying device 307 includes a bottom wall 307*a*, a side wall 307*b*, and an upper wall 307*c* which constitute a container that forms an internal space 300S, a high temperature char injection pipe 307*d* and a cooled char discharge pipe 307*e* which are provided in the side wall 307*b*, a cooling gas discharge pipe 307*f* which is provided in the upper wall 307*c*, and a distributor 307*g* which is disposed in the internal space 300S.

In a case where the fluidized bed cooling and classifying device 307 is viewed in a plan view along the circumferential direction thereof, the high temperature char injection pipe 307*d* and the cooled char discharge pipe 307*e* are provided at opposite positions to each other. In other words, for example, when viewed in the longitudinal cross-sectional view of FIG. 5, the high temperature char injection pipe 307*d* is connected to the left side of the side wall 307*b* in the figure, and the cooled char discharge pipe 307*e* is connected to the right side in the figure which is the opposite side. Furthermore, when viewed along the vertical direction, the position of a connection port P301 between the high temperature char injection pipe 307*d* and the side wall 307*b* is higher than the position of a connection port P302 between the cooled char discharge pipe 307*e* and the side wall 307*b*.

As described above, in the internal space 300S of the fluidized bed cooling and classifying device 307, as illustrated in FIG. 5, in order to fluidize the injected high temperature char C304, the distributor 307*g* in which a number of small through-holes 307*g*1 are formed to allow cooling gas G307 to flow upward in the vertical direction is provided.

The distributor 307*g* is horizontally disposed at substantially the same position as that of the lower end of the connection port P302. The circumferential edge of the distributor 307*g* is fixed to the inner circumferential surface of the side wall 307*b*, and the lower surface thereof is supported at an upper position of the bottom wall 307*a*. As a result, the internal space 300S is partitioned by the distributor 307*g* into a cooling and classifying chamber S301 which cools and classifies the injected high temperature char C304, and a cooling gas supply chamber S302 which is provided immediately below the cooling and classifying chamber S301 and receives the cooling gas 6307 introduced from the bottom wall 307*a*.

The cooling gas G307 supplied from the bottom wall 307*a*, that is the bottom portion of the container included in the fluidized bed cooling and classifying device 307, passes through the through-holes 307*g*1 provided in the distributor 307*g* from the cooling gas supply chamber S302 to the cooling and classifying chamber S301, flows into the cooling and classifying chamber S301 which is the upper portion in the container, and is discharged from the cooling gas discharge pipe 307*f* which is a discharge portion provided in the upper wall 307*c* on the upper side of the container.

The high temperature char C304 generated in the carbonizing device 303 is fed onto the distributor 307*g*, and is fluidized and cooled by the cooling gas G307 which is blown upward from the cooling gas supply chamber S302 that is the lower portion of the container. More specifically, first, the high temperature char C304 is injected into the cooling and classifying chamber S301 through the connection port P301 via the high temperature char injection pipe 307*d*, and is stacked on the distributor 307*g*. Simultaneously, the cooling gas G307 supplied into the cooling gas supply chamber S302 passes upward through the through-holes 307*g*1 from the lower side of the distributor 307*g*. Accordingly, the cooling gas G307 fed into the cooling and classifying chamber S301 as such is blown upward from the lower layer of the high temperature char C304 stacked on the distributor 307*g* to the upper layer thereof. In this procedure, due to the blown cooling gas G307, the high temperature char C304 is fluidized by wind pressure, and is simultaneously cooled. Therefore, in the fluidized bed cooling and classifying device 307 according to this embodiment, the cooling gas G307 supplied from the lower side of the container functions as fluidizing gas.

As the cooling gas G307 (that is, fluidizing gas) supplied to the fluidized bed cooling and classifying device 307, in order to prevent the combustion of the high temperature char C304 in the fluidized bed cooling and classifying device 307, gas (for example, nitrogen gas) which does not contain oxygen is preferably used.

The cooling gas G307 according to this embodiment is supplied to the fluidized bed cooling and classifying device 307 by a supply device which is not illustrated. Unlike this embodiment, as described in the modification example described later, (1) the flue gas from the dust collector 309 may be returned to the fluidized bed cooling and classifying device 307, (2) the flue gas G302 from the dryer 301 may be supplied to the fluidized bed cooling and classifying device 307, and (3) both the flue gas from the dust collector 309 and the flue gas G302 from the dryer 301 may be supplied to the fluidized bed cooling and classifying device 307. In a case where the flue gas G302 from the dryer 301 is supplied, as necessary, the flue gas G302 may be cooled to a predetermined temperature and then supplied.

The high temperature char C304 in the cooling and classifying chamber S301 is fluidized by the cooling gas G307 supplied to the fluidized bed cooling and classifying device 307. However, fine char C306 having a particle size of about 0.3 mm to 0.5 mm rides the cooling gas G307 that flows upward in the vertical direction in the cooling and classifying chamber S301 and is discharged from the cooling gas discharge pipe 307*f* disposed in the upper wall 307*c*.

Cooled char C305 having a greater particle size than the fine char C306 is discharged from a discharge port (the connection port P302) provided in the vicinity of the distributor 307*g* of the fluidized bed cooling and classifying device 307. That is, in the fluidized bed cooling and classifying device 307 according to this embodiment, the high temperature char C304 is cooled, and the high temperature char C304 is classified by using the cooling gas G307 (fluidizing gas). Since the fine char C306 (fine char having a particle size of equal to or less than a predetermined classification point, with a small amount of incorporated char which is greater than the predetermined classification point) having a predetermined particle size is removed by the classification treatment, the ratio of fine particles incorporated into the cooled char C305 that is recovered as a product can be reduced, and dust emission from the manufactured char can be efficiently reduced. Furthermore, since the fine char C306 is removed from the high temperature char C304, pipe clogging and the like which may occur in the pipes that transport the manufactured cooled char C305 can be more effectively suppressed or prevented.

The amount of the fine char C306 obtained by the fluidized bed cooling and classifying device 307 is determined by the initial particle size distribution of the coal C301 injected into the coal reforming apparatus 310 or the flow rate (flow velocity) of the cooling gas G307 which is the fluidizing gas in the fluidized bed cooling and classifying device 307. In addition, the classification point (a target particle size by which the high temperature char C304 having the particle size distribution is classified into the fine char C306 and the cooled char C305 having a greater particle size than the fine char C306) can be adjusted by increasing or reducing the flow rate of the cooling gas G307, and the ratio of the fine char C306 discharged from the upper portion of the fluidized bed cooling and classifying device 307 to the high temperature char C304 can be changed by changing the settings of the classification point.

As illustrated in FIGS. 4 and 5, cooling gas 6308 containing the fine char C306 discharged from the fluidized bed cooling and classifying device 307 is introduced to the dust collector 309. The dust collector 309 is a device which separates the fine char C306 contained in the introduced cooling gas G308 from gas components. As the dust collector 309 according to this embodiment, for example, a cyclone, a bag filter, or the like can be used. The fine char C306 separated by the dust collector 309 is transported to the combustor 311, which will be described later. The gas from which the fine char C306 is removed is discharged to the outside of the system as flue gas.

The combustor 311 is a device which generates heat used in the coal reforming apparatus 310 according to this embodiment. At least a portion of the carbonizing gas D301 generated in the carbonizing device 303 and the fine char C306 recovered by the dust collector 309 are supplied to the combustor 311 as fuel. The combustor 311 burns the carbonizing gas and the fine char to generate the combustion gas G303 having a high temperature of, for example, about 1000° C. to 1500° C. The combustion gas G303 is introduced to the carbonizing device 303, and is used as a heat source for the thermal decomposition reaction in the carbonizing device 303.

As the combustor 311, a combustor for burning the carbonizing gas D301 and a combustor for burning the fine char C306 may be separately provided. However, it is preferable to use a common combustor in which a burner (for example, a char injection pipe and the like) that injects the fine char C306 into a combustion space of the combustor for burning the carbonizing gas D301 is provided. By using the combustor for burning the carbonizing gas D301 and the combustor for burning the fine char C306 in common, the fine char C306 can be injected to a high temperature field where the carbonizing gas D301 that is generally easily burned is burned, and thus the fine char C306 can be easily burned.

In addition, as another embodiment, in a case where an indirect heating type carbonizing device such as an external heating type rotary kiln to which heating gas is supplied from an outside source is used as the carbonizing device 303 and the heating gas G301 discharged from the carbonizing device 303 is supplied to the dryer 301, the carbonizing device 303 may double as the combustor 311 by using an external heat portion (the outer circumferential portion in the external heating type rotary kiln) as a combustion space.

Here, depending on the carbonizing condition of the carbonizing device 303, there may be cases where the temperature of the combustion gas at about 1000° C. to 1500° C. discharged from the combustor 311 is too high. At this time, it is preferable that by using the pipe L301 illustrated in FIG. 4, the flue gas G302 from the dryer 301 be mixed with the combustion gas G303 from the combustor 311. Since the temperature of the flue gas G302 from the dryer 301 is about 100° C. and thus is lower than the temperature of the combustion gas G303 from the combustor 311, the temperature of the combustion gas G303 from the combustor 311 can be adjusted to be an appropriate temperature by mixing the flue gas G302 with the combustion gas G303. In a case where the flue gas G302 from the dryer 301 is not mixed, a heat exchanger (not illustrated) such as a boiler may be provided at an intermediate position of a pipe L302 which supplies the combustion gas G303 from the combustor 311 to reduce the temperature of the combustion gas G303.

Hereinbefore, the configuration of the coal reforming apparatus 310 according to this embodiment has been described in detail with reference to FIGS. 4 and 5.

In a case where the coal C301 having a high moisture content is used as a raw material, even when the carbonizing gas D301 generated in the carbonizing device 303 is used, there may be cases where heat needed for drying and carbonizing is not provided. However, in a coal reforming method using the coal reforming apparatus 310 according to this embodiment, the fluidized bed cooling and classifying device 307 is employed as the cooler, and the fine char C306 classified by the fluidized bed cooling and classifying device 307 is introduced to the combustor 311. Accordingly, even in the case where the coal C301 having a high moisture content is used, a necessary heating value for the drying and the carbonizing can be provided without the supply of other fuels from an outside source.

On the other hand, in a case where the coal C301 in which the moisture content is not high is used, a heat source for drying and carbonizing can be provided by burning the generated carbonizing gas D301. However, in the coal reforming method using the coal reforming apparatus 310 according to this embodiment, by also introducing the fine char C306 discharged from the fluidized bed cooling and classifying device 307 to the combustor 311 to be burned, the amount of the carbonizing gas D301 supplied to the combustor 311 can be reduced. As a result, the amount of gas, tar, or the like recovered as a product can be increased.

The amount of the fine char C306 obtained by the fluidized bed cooling and classifying device 307 is determined by the initial particle size distribution of the coal C301 injected into the coal reforming apparatus 310 or by the flow rate of the cooling gas G307 supplied to the fluidized bed cooling and classifying device 307 as described above. However, in a case where the moisture content of the coal C301 is high and the moisture content of the dried coal C302 at the outlet of the dryer 301 is high, the flow rate of the cooling gas G307 which is the fluidizing gas is increased and the amount of the fine char C306 transported to the combustor 311 is increased to increase the combustion amount, thereby generating a necessary heating value.

In a case where the moisture content of the dried coal C302 at the outlet of the dryer 301 is low, the amount of the fine char C306 transported to the combustor 311 is reduced by reducing the flow rate of the cooling gas G307 which is the fluidizing gas, thereby suppressing the heating value applied from the combustor 311 to the carbonizing device 303. As a result, the amount or the moisture content of the dried coal C302 supplied to the carbonizing device 303 can be adjusted. As described above, in this embodiment, even in a case where the moisture content of the coal C301 or the dried coal C302 changes, the balance in the heating value of the entire coal reforming apparatus 310 can be controlled.

In addition, identifying the moisture content of the dried coal C302 at the output side of the dryer 301 and controlling the flow rate of the cooling gas G307 in the fluidized bed cooling and classifying device 307 may be manually performed by an operator of the coal reforming apparatus 310, and may be automatically performed by various controllers (not illustrated) provided in the coal reforming apparatus 310.

Modification Example

Figure 6:
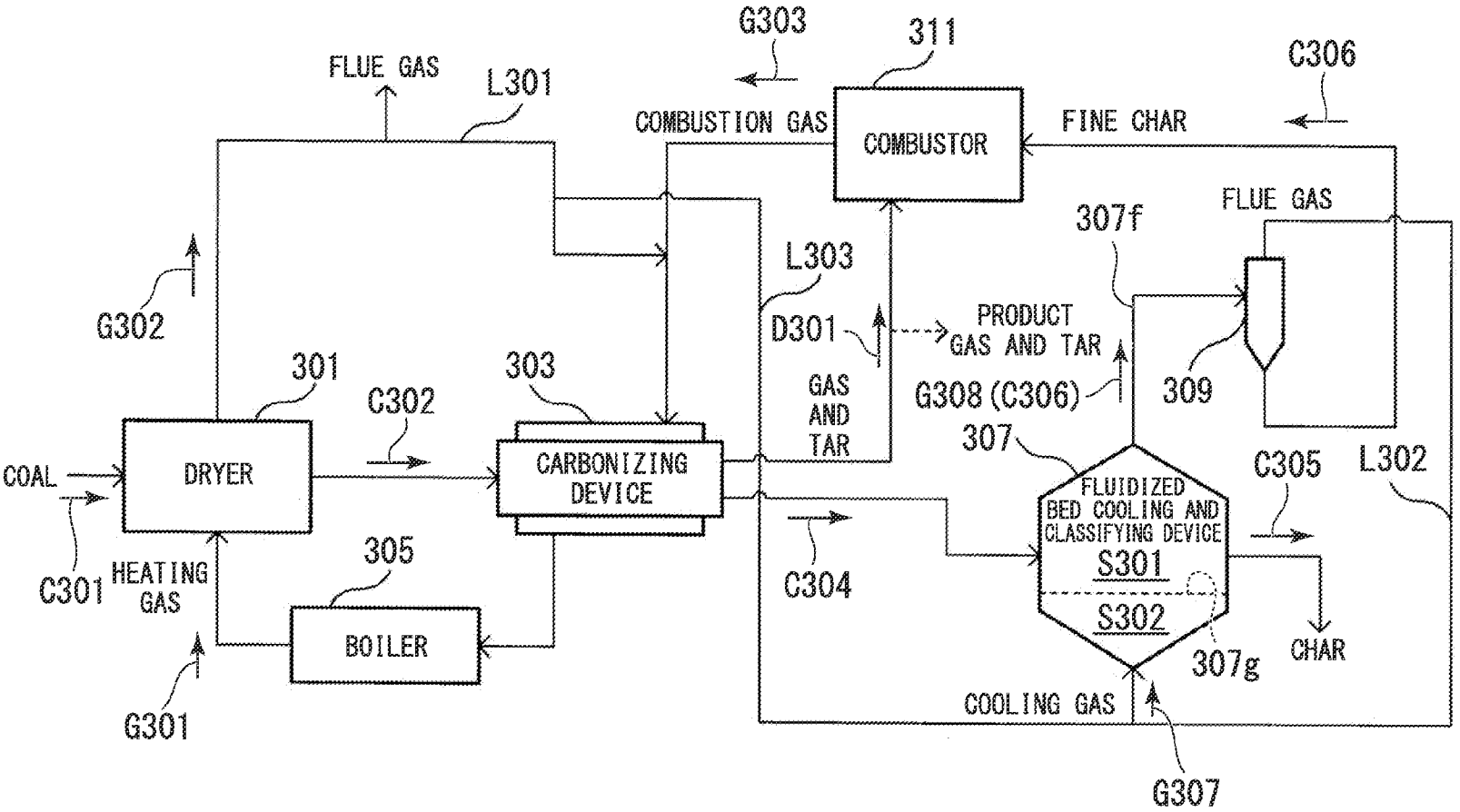
FIG. 6 is a process flowchart illustrating a modification example of the coal reforming apparatus.

Subsequently, a modification example of the coal reforming apparatus 310 according to the second embodiment will be described with reference to FIG. 6. FIG. 6 is a process flowchart illustrating a coal reforming apparatus 310A according to this modification example. In addition, parts that are not included in the following description are the same as those of the second embodiment, and thus description thereof will be omitted.

In the coal reforming apparatus 310 illustrated in FIG. 4, the fine char C306 is separated from the cooling gas G307 supplied to the fluidized bed cooling and classifying device 307 by the dust collector 309, and the separated gas is discharged to the outside of the system as flue gas. In the coal reforming apparatus 310A according to this modification example, as described below, the cooling gas G307 supplied to the fluidized bed cooling and classifying device 307 may be circulated to be used.

That is, in the coal reforming apparatus 310A according to this modification example, the gas which is discharged from the dust collector 309 and from which the fine char C306 is separated is supplied to the fluidized bed cooling and classifying device 307 again as the cooling gas G307 by using the pipe L302 illustrated in FIG. 6.

In addition, as well as the flue gas from the dust collector 309, as illustrated in FIG. 6, a portion of the flue gas G302 discharged from the dryer 301 may be supplied to the fluidized bed cooling and classifying device 307 as the cooling gas G307 by using a pipe L303.

As described above, since at least any one of the flue gas discharged from the dust collector 309 and the flue gas discharged from the dryer 301 is used as the cooling gas G307 supplied to the fluidized bed cooling and classifying device 307, the flow rate of the cooling gas G307 supplied to the fluidized bed cooling and classifying device 307 can be easily adjusted. As a result, the flow rate of the cooling gas G307 can be increased or reduced by increasing or reducing the supply amount of the flue gas supplied to the fluidized bed cooling and classifying device 307, and consequently the flow rate of the fluidizing gas can be adjusted, thereby increasing or reducing the amount of the fine char C306. Accordingly, the coal reforming apparatus 310A according to this modification example can be more efficiently operated.

In addition, in a case where the temperature of the flue gas from the dust collector 309 or the temperature of the flue gas from the dryer 301 is higher than a predetermined temperature and thus is not appropriate for being used as the cooling gas G307, a well-known cooler (not illustrated) may be provided at an intermediate position of the pipe L302 or the pipe L303 to reduce the temperature to a temperature at which the flue gas can be used as the cooling gas G307.

(Third Embodiment)

In the coal reforming apparatus 310 according to the second embodiment, the fluidized bed cooling and classifying device 307 is used as the cooler provided at a later stage of the carbonizing device 303. However, in a coal reforming apparatus 410 according to a third embodiment, in addition to the cooler, a dryer using a fluidized bed (fluidized bed drying and classifying device 351) is used as the dryer provided at a previous stage of the carbonizing device 303. Hereinafter, the coal reforming apparatus 410 according to this embodiment will be described with reference to FIGS. 7 and 8. In the following description, differences from the second embodiment will be mainly described.

Figure 7:
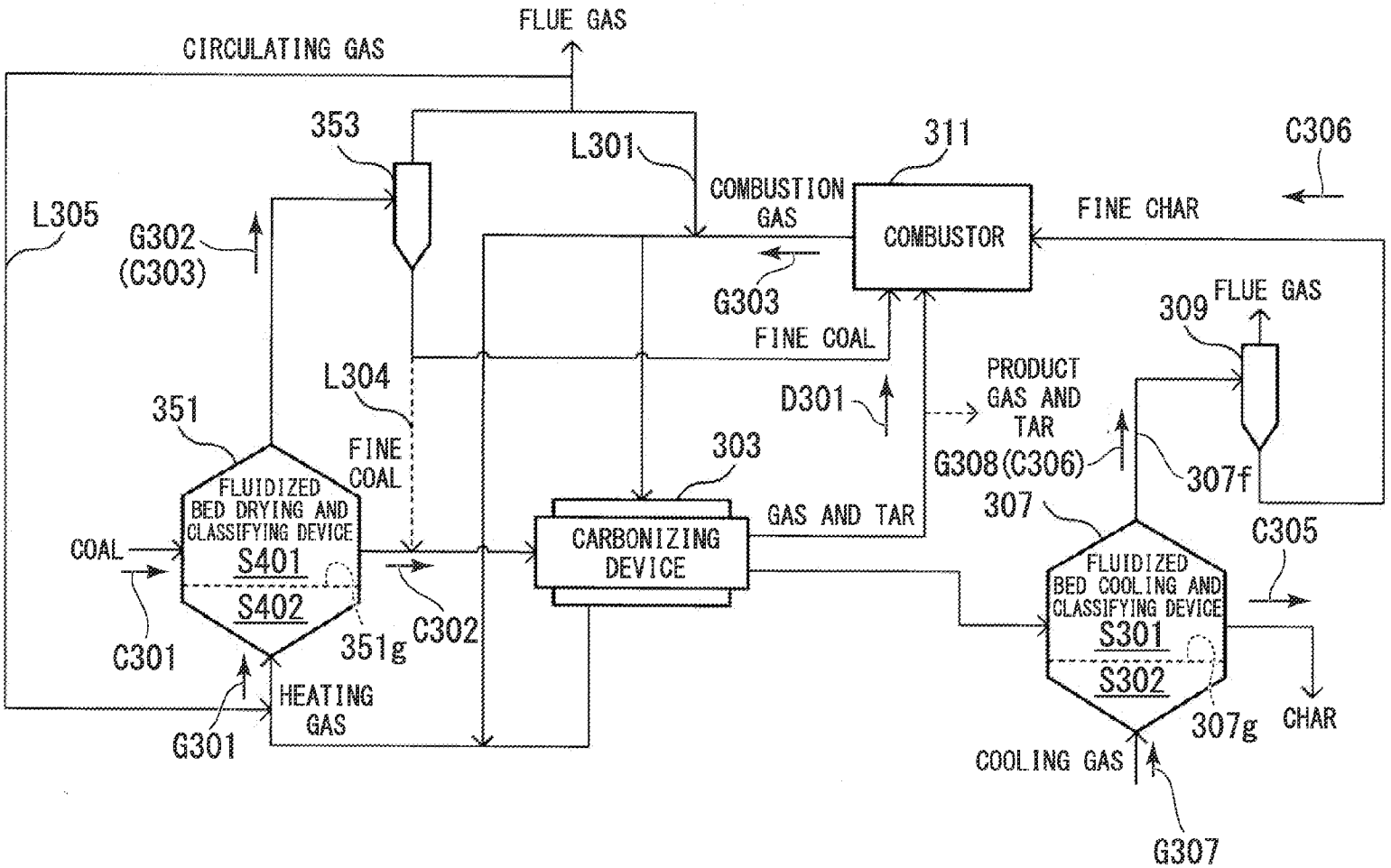
FIG. 7 is a process flowchart illustrating the configuration of a coal reforming apparatus according to a third embodiment of the present invention.

The coal reforming apparatus 410 according to this embodiment mainly includes a fluidized bed drying and classifying device 351, the carbonizing device 303, the fluidized bed cooling and classifying device 307, dust collectors 309 and 353, and the combustor 311 as illustrated in FIG. 7.

The carbonizing device 303, the fluidized bed cooling and classifying device 307, the dust collector 309, and the combustor 311 which are included in the coal reforming apparatus 410 according to this embodiment have the same configurations and the same effects as those of the carbonizing device 303, the fluidized bed cooling and classifying device 307, the dust collector 309, and the combustor 311 of the coal reforming apparatus 310 described in the second embodiment, and thus detailed description thereof will be omitted.

As described above, the dryer is a device which heats the coal C301 having a particle size distribution that is supplied to the coal reforming apparatus 410 to remove moisture contained in the coal C301, thereby drying the coal C301 to have a predetermined moisture content. In the coal reforming apparatus 410 according to this embodiment, as illustrated in FIGS. 7 and 8, the fluidized bed drying and classifying device 351 is used as the dryer.

Figure 8:
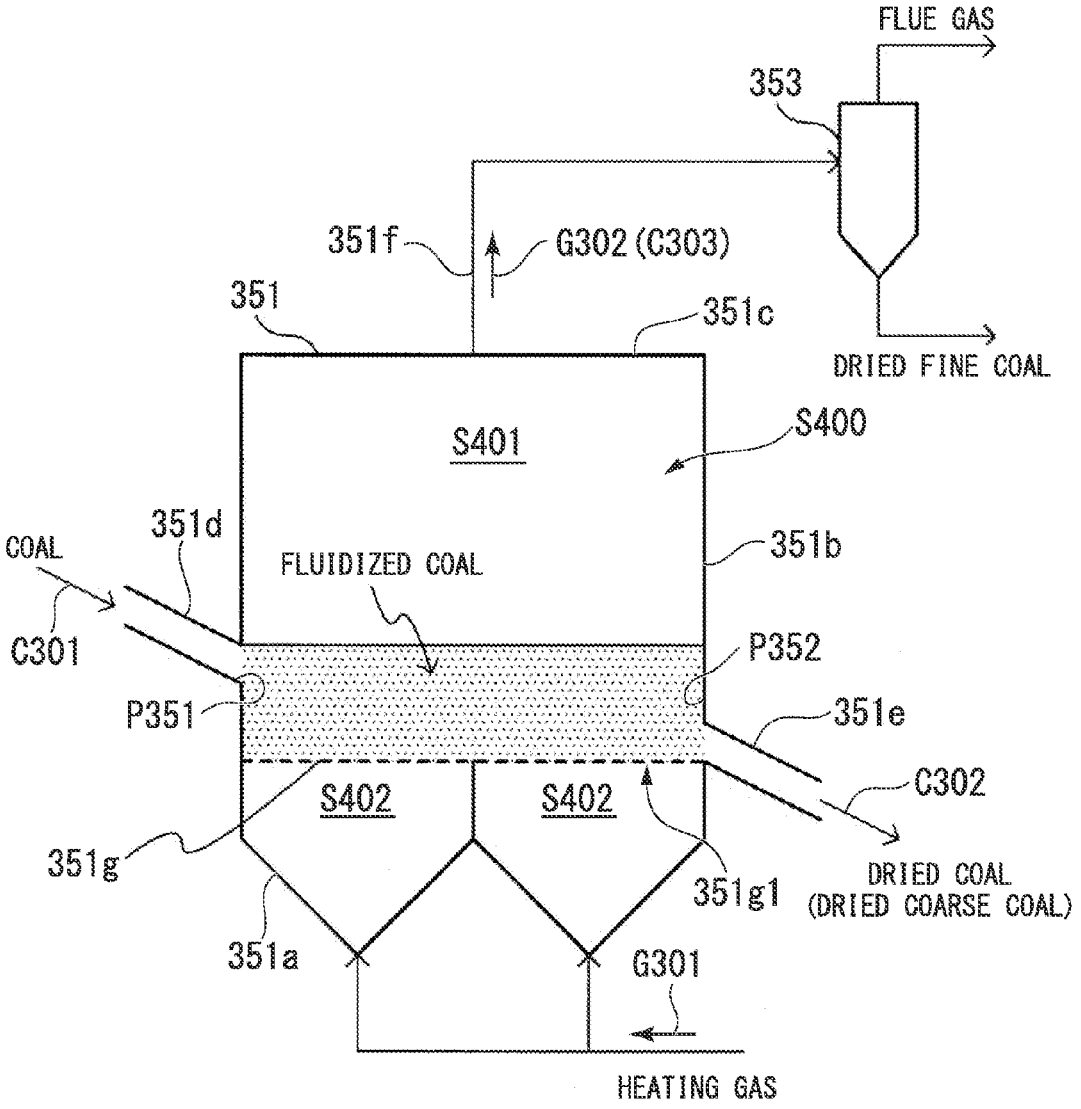
FIG. 8 is a longitudinal cross-sectional view illustrating a fluidized bed drying and classifying device of the coal reforming apparatus.

As illustrated in FIG. 8, the fluidized bed drying and classifying device 351 includes a bottom wall 351*a*, a side wall 351*b*, and an upper wall 351*c* which constitute a container that forms an internal space S400, a coal injection pipe 351*d* and a dried coal discharge pipe 351*e* which are provided in the side wall 351*b*, a heating gas discharge pipe 351*f* which is provided in the upper wall 351*c*, and a distributor 351*g* which is disposed in the internal space S400.

In a case where the fluidized bed drying and classifying device 351 is viewed in a plan view along the circumferential direction thereof, the coal injection pipe 351*d* and the dried coal discharge pipe 351*e* are provided at opposite positions to each other. In other words, for example, when viewed in the longitudinal cross-sectional view of FIG. 8, the coal injection pipe 351*d* is connected to the left side of the side wall 351*b* in the figure, and the dried coal discharge pipe 351*e* is connected to the right side in the figure which is the opposite side. Furthermore, when viewed along the vertical direction, the position of a connection port P351 between the coal injection pipe 351*d* and the side wall 351*b* is higher than the position of a connection port P352 between the dried coal discharge pipe 351*e* and the side wall 351*b*.

As described above, in the internal space S400 of the fluidized bed drying and classifying device 351, as illustrated in the longitudinal cross-sectional view of FIG. 8, in order to fluidize the injected coal C301, the distributor 351*g* in which a number of small through-holes 351*g*1 are formed to allow the heating gas G301 to flow is provided.

The distributor 351*g* is horizontally disposed at substantially the same position as that of the lower end of the connection port P352. The circumferential edge of the distributor 351*g* is fixed to the inner circumferential surface of the side wall 351*b*, and the lower surface thereof is supported at an upper position of the bottom wall 351*a*. As a result, the internal space S400 is partitioned by the distributor 351*g* into a drying and classifying chamber S401 which dries and classifies the injected coal C301, and a heating gas supply chamber S402 which is provided immediately below the drying and classifying chamber S401 and receives the heating gas G301 introduced from the bottom wall 351*a*.

The heating gas G301 supplied from the bottom wall 351*a*, that is the bottom portion of the container included in the fluidized bed drying and classifying device 351, passes upward through the through-holes 351*g*1 provided in the distributor 351*g* from the heating gas supply chamber S402, flows into the drying and classifying chamber S401 which is the upper portion in the container, and is discharged from the heating gas discharge pipe 351*f* which is a discharge portion provided in the upper wall 351*c* on the upper side of the container.

The coal C301 having a particle size distribution is fed onto the distributor 351*g*, and is fluidized and heated by the heating gas G301 which is blown upward from the heating gas supply chamber S402 that is the lower portion of the container. More specifically, first, the coal C301 is continuously injected into the drying and classifying chamber S401 through the connection port P351 via the coal injection pipe 351*d*, and is stacked on the distributor 351*g*. Simultaneously, the heating gas G301 supplied into the heating gas supply chamber S402 passes upward through the through-holes 351*g*1 from the lower side of the distributor 351*g*. Accordingly, the heating gas G301 fed into the drying and classifying chamber S401 as such is blown upward from the lower layer of the coal C301 stacked on the distributor 351*g* to the upper layer thereof. In this procedure, due to the blown heating gas G301, the coal C301 is fluidized by wind pressure, and is simultaneously dried through heating. Therefore, in the fluidized bed drying and classifying device 351 according to this embodiment, the heating gas G301 supplied from the lower side of the container functions as heating and drying gas, and also functions as fluidizing gas.

The coal C301 in the fluidized bed drying and classifying device 351 is fluidized by the heating gas G301 supplied to the fluidized bed drying and classifying device 351 and is heated by the heating gas G301 such that moisture contained therein is removed. Here, in the fluidized bed drying and classifying device 351, the internal atmospheric temperature is maintained at about 100° C. by the supplied heating gas G301, and the supplied coal C301 is heated so that the temperature of the coal C302 at the outlet of the fluidized bed drying and classifying device 351 is about several tens of ° C. to 100° C. (preferably, for example, about 80° C. to 100° C.). Accordingly, moisture contained in the supplied coal C301 is removed. In a case where the temperature of the dried coal C302 at the outlet of the fluidized bed drying and classifying device 351 is less than a temperature lower limit (for example, less than 80° C.) which is permitted on facility design, there is a possibility that moisture may remain in the dried coal C302 at a content equal to or higher than a predetermined target value, which is not preferable. In addition, in a case where the temperature of the dried coal C302 at the outlet of the fluidized bed drying and classifying device 351 is much higher than 100° C., there is a possibility that carbonizing the dried coal C302 may be started, which is not preferable.

The internal temperature of the fluidized bed drying and classifying device 351 may be controlled according to, for example, the flow rate and the like of the heating gas G301 supplied to the fluidized bed drying and classifying device 351. In addition, the moisture content of the dried coal C302 at the output side of the fluidized bed drying and classifying device 351 may be appropriately set according to the target value of the moisture content in the dried coal C302 supplied to the carbonizing device 303 at a later stage, predetermined operation regulations, and the like.

The heating gas G301 is supplied to the fluidized bed drying and classifying device 351 such that the coal C301 is fluidized. Accordingly, fine coal C303 having a particle size of, for example, about 0.3 mm to 0.5 mm rides on the heating gas G301 that flows upward in the fluidized bed drying and classifying device 351 and is discharged from the upper portion of the fluidized bed drying and classifying device 351. In addition, coarse coal having a greater particle size than the fine coal C303 is discharged from the connection port P352 of the dried coal discharge pipe 351*e* which is a discharge port provided in the vicinity of the distributor 351*g* of the fluidized bed drying and classifying device 351. Furthermore, the moisture of the coarse coal is removed to finally be a predetermined moisture content (for example, a moisture content of 10% or the like), and the coarse coal is transported to the carbonizing device 303 provided at the later stage. The heating gas G302 containing the fine coal C303 which is discharged from the fluidized bed drying and classifying device 351 is introduced to the dust collector 353, which will be described later, as illustrated in FIGS. 7 and 8.

As described above, in the fluidized bed drying and classifying device 351 according to this embodiment, the coal C301 containing moisture is dried, and simultaneously, the coal C301 is classified by using the heating gas (fluidizing gas) G301. By the classification treatment, the fine coal C303 (fine coal having a particle size of equal to or less than a predetermined classification point, with a small amount of incorporated coal which is greater than the predetermined classification point) having a predetermined particle size is removed. Therefore, the ratio of the fine particles incorporated into the dried coal C302 (the coarse coal after being dried) supplied to the carbonizing device 303 can be reduced. Furthermore, a calibration problem caused by the incorporation of the fine coal into the carbonizing gas D301 (including tar) which is generated in and discharged from the carbonizing device 303 is more easily reduced, and thus clogging and the like of pipes can be more effectively suppressed or prevented.

In addition, the dried coal C302 from which the fine coal C303 is removed is reformed in the carbonizing device 303, and thereafter the fine char C306 is further removed by the fluidized bed cooling and classifying device 307. Therefore, fine particles contained in the char C305 that is recovered as a product can be more efficiently removed, thereby very efficiently reducing dust emission from the char C305.

The amount of the fine coal C303 obtained by the fluidized bed drying and classifying device 351 is determined by the initial particle size distribution of the coal C301 injected into the coal reforming apparatus 410 or the flow rate of the heating gas G301 which is the fluidizing gas in the fluidized bed drying and classifying device 351. The classification point (a target particle size by which the coal C301 having the particle size distribution is classified into the fine coal C303 and the coarse coal C302) can be also adjusted by the flow rate of the heating gas G301 which is the fluidizing gas, and the ratio of the fine coal C303 discharged from the upper portion of the fluidized bed drying and classifying device 351 can be changed by changing the setting of the classification point.

As illustrated in FIGS. 7 and 8, the flue gas G302 containing the fine coal C303 discharged from the fluidized bed drying and classifying device 351 is introduced to the dust collector 353. The dust collector 353 is a device which separates the fine coal C303 contained in the introduced flue gas G302 from gas components. As the dust collector 353 according to this embodiment, for example, a cyclone, a bag filter, or the like can be used. The fine coal (dried fine coal) C303 separated by the dust collector 353 is transported to the combustor 311. The gas from which the fine coal C303 is removed is discharged to the outside of the system as flue gas.

Moreover, in a case where the amount of the dried coal C302 transported from the fluidized bed drying and classifying device 351 to the carbonizing device 303 is small, or in a case where the moisture content of the dried coal C302 at the outlet of the fluidized bed drying and classifying device 351 is equal to or less than a predetermined value, a portion of the fine coal C303 recovered by the dust collector 353 may be supplied to the carbonizing device 303 by using a pipe L304 illustrated in FIG. 7. Accordingly, operations can be optimized by increasing the amount of the dried coal C302, increasing the moisture content of the dried coal C302, and the like. At this time, by using a forming machine, which is not illustrated, such as a molding machine or a granulator, the fine coal C303 supplied to the carbonizing device 303 may be molded or granulated singly or together with the dried coal C302.

By forming the fine coal C303 into a molded material or a granulated material in advance, dust emission in the carbonizing device 303 can be suppressed, and the amount of fine char which scatters along with gas can be reduced, thereby increasing the yield of the generated char C305. The molding can be performed by compression molding, extrusion forming, or the like, and the granulating can be performed by rolling granulation or the like. In order to improve moldability or granulation properties, a binder such as tar or cement may be added to the fine coal C303. Regarding the size of the molded material or the granulated material, in terms of the suppression of dust emission and prevention of scattering, it is preferable that the diameter (the diameter is a diameter based on the premise of sieving and is equivalent to a minor axis) of the material be equal to or higher than about several millimeters. Although the upper limit of the diameter is not particularly limited, in consideration of easiness of molding, granulating, and handling and easiness of heat transfer into the char, it is preferable that the diameter be equal to or less than several tens of millimeters. The size of the molded material or the granulated material is also influenced by the performance of the molding machine or the granulator, and is generally about several centimeters to 10 cm, for example, in a case of briquette molding.

In the above description, a case where the flue gas discharged from the carbonizing device 303 is used as both the heating gas and the fluidizing gas is described. However, for example, as illustrated in FIG. 7, the combustion gas discharged from the combustor 311 may be cooled by the flue gas supplied from the pipe L301 as necessary and thereafter be directly supplied to the fluidized bed drying and classifying device 351. In the case where the combustion gas G303 discharged from the combustor 311 is used, the carbonizing temperature of the carbonizing device 303 can be easily controlled by adjusting the mixing amount of the flue gas from the pipe L301, which is more preferable. In addition, in a case where the internal temperature of the fluidized bed drying and classifying device 351 is controlled to be higher than 100° C., a boiler which is not illustrated may be additionally provided at an intermediate position of a pipe supplied from the carbonizing device 303 so that steam generated in the boiler is used as the heating gas G301.

In the above description, a case where the flue gas discharged from the carbonizing device 303 is supplied to the fluidized bed drying and classifying device 351 as both the heating gas and the fluidizing gas is described. However, at least a portion of the flue gas discharged from the dust collector 353 may be mixed with the heating gas G301 as circulating gas by using a pipe L305 illustrated in FIG. 7. By mixing the flue gas discharged from the dust collector 353 in the fluidized bed drying and classifying device 351, the flow rate or the temperature of the gas supplied to the fluidized bed drying and classifying device 351 can be easily adjusted, and the coal reforming apparatus 410 can be more efficiently operated.

Hereinbefore, the coal reforming apparatus 410 according to this embodiment has been described with reference to FIGS. 7 and 8.

In a coal reforming method using the coal reforming apparatus 410 according to this embodiment, the fluidized bed drying and classifying device 351 is used as the dryer, the fluidized bed cooling and classifying device 307 is used as the cooler, and the fine coal C303 and the fine char C306 which are separately generated are introduced to the combustor 311. Accordingly, even in the case where the coal C301 having a high moisture content is used, a necessary heating value for the drying and the carbonizing can be provided without the supply of other fuels from an outside source.

In addition, in a case where the coal C301 in which the moisture content is not high is used, a heat source for drying and carbonizing can be provided by burning the generated volatile components. By using the dried fine coal C303 obtained by the fluidized bed drying and classifying device 351 or the fine char C306 obtained by the fluidized bed cooling and classifying device 307 as the heat source of the coal reforming apparatus 410, the amount of gas or tar recovered as a product can be increased.

The amount of the dried fine coal C303 obtained by the fluidized bed drying and classifying device 351 is determined by the particle size distribution of the coal C301 injected into the coal reforming apparatus 410 or by the flow rate of the heating gas G301 in the fluidized bed drying and classifying device 351 as described above. However, in a case where the moisture content of the coal C301 is high and the moisture content of the dried coal C302 at the outlet of the fluidized bed drying and classifying device 351 is high, the flow rate of the heating gas G301 which is the fluidizing gas is increased to increase the amount of the dried fine coal C303 transported to the combustor 311, thereby generating a necessary heating value. In a case where the moisture content of the dried coal C302 at the outlet of the fluidized bed drying and classifying device 351 is low, the amount of the dried fine coal C303 transported to the combustor 311 is reduced by reducing the flow rate of the heating gas G301, or the dried fine coal C303 is transported to the carbonizing device 303 via the pipe L304 illustrated in FIG. 7, thereby adjusting the amount or the moisture content of the dried coal C302 supplied to the carbonizing device 303. At this time, as described above, the dried fine coal C302 may be molded or granulated singly or together with the dried coal C302 in advance. As such, in this embodiment, even in a case where the moisture content of the dried coal C302 changes, the balance in the heating value of the entire coal reforming apparatus 410 can be controlled.

In order to adjust the amount of the dried fine coal C303 recovered in the dust collector 353, for example, the flue gas discharged from the dust collector 353 is supplied to the fluidized bed drying and classifying device 351 as the circulating gas by using the pipe L305 illustrated in FIG. 7, and the flow rate of the heating gas G301 is increased or reduced by increasing or reducing the supply amount to adjust the flow rate of the fluidizing gas, thereby increasing or reducing the amount of the dried fine coal C303. In this case, even when the circulating gas supplied from the pipe L305 is mixed, the flow rate of the heating gas supplied from the carbonizing device 303 is adjusted so that the heating gas 6301 can maintain a desired heating value.

In addition, as the cooling gas G307 supplied to the fluidized bed cooling and classifying device 307, at least any one of the flue gas from the dust collector 309 and the flue gas from the dust collector 353 or cooling gas from a gas supply device which is not illustrated may be used.

In addition, identifying the moisture content of the dried coal C302 at the output side of the fluidized bed drying and classifying device 351, controlling the introduction of the fine coal C303 from the dust collector 353, and controlling the flow rate of the fluidizing gas in the fluidized bed drying and classifying device 351 and the fluidized bed cooling and classifying device 307 may be manually performed by an operator of the coal reforming apparatus 410, and may be automatically performed by various controllers (not illustrated) provided in the coal reforming apparatus 410.

Modification Example

Figure 9:
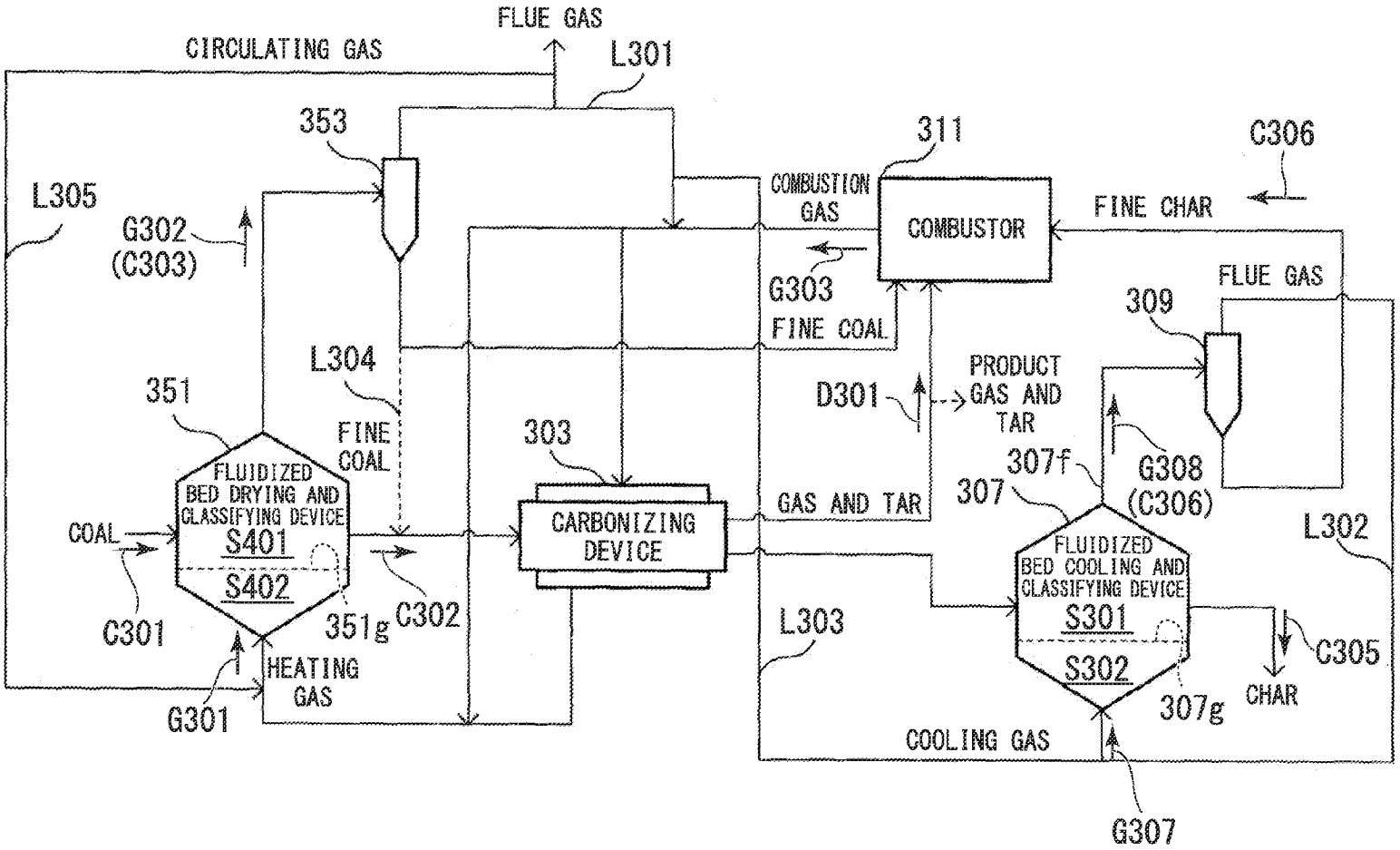
FIG. 9 is a process flowchart illustrating a modification example of the coal reforming apparatus.

Subsequently, a coal reforming apparatus 410A which is a modification example of the coal reforming apparatus 410 according to the third embodiment will be described with reference to FIG. 9. FIG. 9 is a process flowchart illustrating the coal reforming apparatus 410A according to this modification example. In addition, in the following description, differences from the third embodiment will be mainly described. The other features are postulated to be the same as those of the third embodiment, and the description thereof will be omitted.

In the coal reforming apparatus 410A according to this modification example, similarly to the coal reforming apparatus 310A described in the modification example of the second embodiment, the cooling gas supplied to the fluidized bed cooling and classifying device 307 can be circulated to be used.

That is, in the coal reforming apparatus 410A according to this modification example, the flue gas which is discharged from the dust collector 309 and from which the fine char C306 is separated is supplied to the fluidized bed cooling and classifying device 307 again as the cooling gas G307 by using the pipe L302 illustrated in FIG. 9.

In addition, as well as the flue gas from the dust collector 309, as illustrated in FIG. 9, a portion of the flue gas which is discharged from the fluidized bed drying and classifying device 351 and from which the fine coal C303 is removed in the dust collector 353 may be supplied to the fluidized bed cooling and classifying device 307 as the cooling gas G307 by using the pipes L301 and L303.

As described above, since at least any one of the flue gases discharged from the dust collectors 309 and 353 is used as the cooling gas 6307 supplied to the fluidized bed cooling and classifying device 307, the flow rate of the cooling gas G307 supplied to the fluidized bed cooling and classifying device 307 can be easily adjusted. As a result, the flow rate of the cooling gas G307 can be increased or reduced by increasing or reducing the supply amount of the flue gas supplied to the fluidized bed cooling and classifying device 307, and consequently the flow rate of the fluidizing gas can be adjusted, thereby increasing or reducing the amount of the fine char C306. Therefore, the coal reforming apparatus 410A according to this modification example can be more efficiently operated.

In addition, in a case where the temperature of the flue gas transported from the dust collector 309 or the temperature of the flue gas transported from the fluidized bed drying and classifying device 351 is higher than a predetermined temperature, a well-known cooler (not illustrated) may be provided at an intermediate position of the pipe L302 or the pipe L303 to reduce the temperature to a temperature at which the flue gas can be used as the cooling gas G307.

Hereinbefore, the modification example of the third embodiment has been simply described with reference to FIG. 9.

In the second and third embodiments and the modification examples thereof, the method and the apparatus for efficiently reforming the coal C301 without the supply of fuels from an outside source are described. However, in a case where external fuels can be obtained at a relatively low cost, as another embodiment of the present invention, heating gas manufactured by using the external fuels may be used to perform carbonizing, and carbonizing gas generated as a result may be recovered as a product.

For example, in an environment in which gas that has a low heating value and needs a low cost (for example, blast furnace gas (BFG) generated in the steel industry) can be acquired, the gas is burned in the combustor 311, the generated combustion gas G303 is used in the carbonizing device 303 as the heating gas, and the generated carbonizing gas D301 having a high heating value may also be recovered as a product. Even in this case, since the fine coal C303 or the fine char C306 is burned in the combustor 311, calibration caused by the incorporation of the fine coal or the fine char into the carbonizing gas D301 can also be reduced while operations are performed relatively efficiently.

In addition, in a case where the external fuels are used as described above, the carbonizing gas D301 may be separated into gas and tar to be recovered, the tar may further be decomposed to be recovered, or the gas or the tar may be reformed to be recovered.

Examples

Subsequently, while describing Examples 4 to 6 and Comparative Example 2, the coal reforming apparatus 310 (FIG. 4) according to the second embodiment and the coal reforming apparatus 410 (FIG. 7) according to the third embodiment will be described in more detail. In addition, Examples described as follows are only examples, and the present invention is not construed as being limited only to Examples 4 to 6 described as follows.

In Examples 4 to 6 and Comparative Example 2 described as follows, coal having a particle size distribution illustrated in the following Table 2 was used as a raw material.

[Table 2]

TABLE 2

| Particle size distribution of coal | |
|---|---|
| Particle size | Distribution [mass %] |
| 5 mm or greater | 0.0 |
| 3 to 5 mm | 1.0 |
| 1 to 3 mm | 33.0 |
| 0.5 to 1 mm | 35.8 |
| 0.25 to 0.5 mm | 17.6 |
| Less than 0.25 mm | 12.6 |
| Total | 100.0 |

Example 4

Example 4 corresponds to the second embodiment which is described with reference to FIG. 4. In Example 4, the coal C301 (having a moisture content of 60%) which was coarsely crushed and had the particle size distribution illustrated in Table 2 was injected into the indirect heating type dryer 301 having the steam tube type at 600 kg/h (240 kg/h excluding moisture), and was dried until the moisture content became 10%. The temperature of the obtained dried coal C302 was increased to 600° C. in the carbonizing device 303 using the external heating type rotary kiln for carbonizing. As a result, char at 138 kg/h, gas (gas that mainly contained CO, $H_2$, and $CH_4$ and had a heating value of 3450 kcal/$Nm^3$) at 69 $Nm^3$/h, and tar at 19 kg/h could be obtained, and the obtained total amount was transported to the combustor 311 and was burned to obtain the combustion gas at 1500° C. In addition to the volatile components, the fine char C306 at 9 kg/h recovered by the fluidized bed cooling and classifying device 307 was simultaneously burned in the combustor 311. In Example 4, the amount of the char C305 finally recovered as a product was 129 kg/h. In addition, in Example 4, the combustion gas G303 was cooled by using the pipe L301 illustrated in FIG. 4.

Example 5

Example 5 corresponds to the third embodiment which is described with reference to FIG. 7. In Example 5, the coal C301 (having a moisture content of 60%) which was coarsely crushed and had the particle size distribution illustrated in Table 2 was injected into the fluidized bed drying and classifying device 351 at 600 kg/h (240 kg/h excluding moisture), and was dried in the fluidized bed drying and classifying device 351 by using the heating gas G301 at 350° C. and 2600 $Nm^3$/h until the moisture content became 10%. The temperature of the obtained dried coal C302 was increased to 600° C. in the carbonizing device 303 using the external heating type rotary kiln for carbonizing. As a result, char C305 at 135 kg/h, gas (gas that mainly contained CO, $H_2$, and $CH_4$ and had a heating value of 3450 kcal/$Nm^3$) at 68 $Nm^3$/h, and tar at 19 kg/h could be obtained, and the obtained total amount was transported to the combustor 311 to obtain the combustion gas G303 at 1500° C. In addition to the volatile components, the dried fine coal C303 at 10 kg/h recovered by the fluidized bed drying and classifying device 351 and the fine char C306 at 5 kg/h recovered by the fluidized bed cooling and classifying device 307 were simultaneously burned in the combustor 311. In Example 5, the amount of the char C305 finally recovered as a product was 130 kg/h. In addition, in Example 5, the combustion gas G303 was cooled by using the pipe L301 illustrated in FIG. 7. When the inside of the pipe from the carbonizing device 303 to the combustor 311 was inspected after the operation, dust adhesion had rarely occurred, and carryover had rarely occurred.

Example 6

Example 6 corresponds to the third embodiment which is described with reference to FIG. 7. In Example 6, the coal C301 (having a moisture content of 58%) which was coarsely crushed and had the particle size distribution illustrated in Table 2 was injected into the fluidized bed drying and classifying device 351 at 571 kg/h (240 kg/h excluding moisture), and was dried in the fluidized bed drying and classifying device 351 by using the heating gas G301 at 320° C. and 2600 $Nm^3$/h until the moisture content became 10%. The temperature of the obtained dried coal C302 was increased to 600° C. in the carbonizing device 303 using the external heating type rotary kiln for carbonizing. As a result, char at 135 kg/h, gas (gas that mainly contained CO, $H_2$, and $CH_4$ and had a heating value of 3450 kcal/$Nm^3$) at 68 $Nm^3$/h, and tar at 19 kg/h could be obtained, and the obtained total amount was transported to the combustor 311 to obtain the combustion gas G303 at 1500° C. In addition to the volatile components, the dried fine coal C303 at 7 kg/h recovered by the fluidized bed drying and classifying device 351 and the fine char C306 at 2 kg/h recovered by the fluidized bed cooling and classifying device 307 were simultaneously burned in the combustor 311. In Example 6, the amount of the char C305 finally recovered as a product was 133 kg/h, and thus the recovery amount (recovery rate) of the char was increased. In addition, in Example 6, 8 kg of the fine coal C303 among 15 kg of the fine coal C303 recovered in the fluidized bed drying and classifying device 351 was injected into the carbonizing device 303 by using the pipe L304 illustrated in FIG. 7 after being subjected to the compression molding by a molding machine (not illustrated), and the combustion gas G303 was cooled by using the pipe L301 illustrated in FIG. 7. When the inside of the pipe from the carbonizing device 303 to the combustor 311 was inspected after the operation, dust adhesion had rarely occurred, and carryover had rarely occurred.

Comparative Example 2

Comparative Example 2 in which coal was reformed by a method in the related art using an apparatus which is not illustrated in the related art is described as follows.

First, coal (having a moisture content of 60%) which was coarsely crushed and had the particle size distribution illustrated in Table 2 was injected into the band dryer at 600 kg/h, and the coal was dried in the band dryer by using gas at 330° C. and 2700 $Nm^3/h$ until the moisture content became 10%. The temperature of the obtained dried coal was increased to 600° C. in the carbonizing device using the external heating type rotary kiln for carbonizing. As a result, char at 139 kg/h, gas (gas that mainly contained CO, $H_2$, and $CH_4$ and had a heating value of 3450 kcal/$Nm^3$) at 69 $Nm^3/h$, and tar at 19 kg/h could be obtained, and the obtained total amount was transported to the combustor to obtain the combustion gas at 1500° C. As a result, a necessary heating value for the dryer and the carbonizing device could not be provided, and thus heavy oil at 16 kg/h was supplied to the combustor and was burned to secure a necessary heating value for treatments. As described above, in a case where fine char from the fluidized bed cooling and classifying device was not used, heavy oil at 16 kg/h was necessary. When the inside of the pipe from the carbonizing device to the combustor was inspected after the operation, it was seen that dust adhesion occurred (particularly significantly in bent portions), and carryover had occurred. Therefore, there is concern that the pipe may be clogged during an operation over a long period of time.

While the embodiments and the modification examples of the present invention have been described above, the gist thereof is collected as follows.

(15) The coal reforming method includes: drying the coal C301 by the dryer 301; performing the carbonizing on the dried coal C302 by the carbonizing device 303 to be reformed into the carbonizing gas D301 and the char C304; classifying the char C304 while cooling the char C304 by the fluidized bed cooling and classifying device 307 to separate the fine char C306 from the char C304; and supplying the heat obtained by supplying at least a portion of the fine char C306 and the carbonizing gas D301 to the combustor 311 and burning the portion, to at least any one of the dryer 301 and the carbonizing device 303 as the heat source.

(16) The coal reforming method described in (15) may further include: supplying the flue gas discharged from at least any one of the dryer 301 and the fluidized bed cooling and classifying device 307 to the fluidized bed cooling and classifying device 307 as the cooling gas.

(17) The coal reforming method described in (15) or (16) may further include: mixing at least a portion of the flue gas G302 discharged from the dryer 301 with the combustion gas G303 supplied from the combustor 311 to at least any one of the dryer 301 and the carbonizing device 303.

(18) In the coal reforming method described in any one of (15) to (17), the carbonizing device 303 is of an indirect heating type which is supplied with the heating gas from an outside source, and supplying the heating gas G301 discharged from the carbonizing device 303 to the dryer 301 may be further included.

(19) The coal reforming method described in any one of (15) to (18) may further include: classifying the coal C301 into the coarse coal that is the dried coal C302 and the fine coal C303 while drying the coal C301 by using the fluidized bed drying and classifying device 351 as the dryer, in the drying of the coal C301 by the dryer; and supplying the fine coal C303 to the combustor 311.

(20) The coal reforming method described in (19) may further include: mixing at least a portion of the flue gas G302 discharged from the fluidized bed drying and classifying device 351 with the heating gas G303 supplied to the fluidized bed drying and classifying device 351 as the heat source.

(21) The coal reforming method described in (19) or (20) may further include: supplying at least a portion of the fine coal C303 obtained by the fluidized bed drying and classifying device 351 to the carbonizing device 303.

(22) In the coal reforming method described in (21), at least a portion of the fine coal C303 obtained by the fluidized bed drying and classifying device 351 may be supplied to the carbonizing device 303 after being formed singly or together with the dried coal C302.

(23) In the coal reforming method described in any one of (15) to (22), instead of the carbonizing gas D301 among the fine char C306 and the carbonizing gas D301 which are supplied to the combustor 311, the external fuel may be used.

(24) The coal reforming apparatus 310 includes: the dryer 301 which dries the coal C301; the carbonizing device 303 which performs the carbonizing on the dried coal C302 to be reformed into the carbonizing gas D301 and the char C304; the fluidized bed cooling and classifying device 307 which classifies the char C304 while cooling the char C304 to separate the fine char C306 from the char C304; and the combustor 311 which is supplied with at least a portion of the fine char C306 and the carbonizing gas D301 and supplies the heat obtained by burning the carbonizing gas D301 and the fine char C306, to at least any one of the dryer 301 and the carbonizing device 303 as the heat source.

(25) In the coal reforming apparatus 310 described in (24), the flue gas discharged from at least any one of the dryer 301 and the fluidized bed cooling and classifying device 307 may be supplied to the fluidized bed cooling and classifying device 307 as the cooling gas.

(26) The coal reforming apparatus 310 described in (24) or (25) may be configured so that at least a portion of the flue gas G302 discharged from the dryer 301 is mixed with the combustion gas G303 supplied from the combustor 311 to at least any one of the dryer 301 and the carbonizing device 303 as the heat source.

(27) In the coal reforming apparatus 310 described in any one of (24) to (26), the carbonizing device 303 is of an indirect heating type which is supplied with the heating gas from an outside source, and a configuration in which the heating gas G301 discharged from the carbonizing device 303 is supplied to the dryer 301 may be employed.

(28) The coal reforming apparatus 410 which is another embodiment of the coal reforming apparatus 310 described in any one of (24) to (27) may employ a configuration in which the dryer is the fluidized bed drying and classifying device 351 which classifies the coal C301 into the coarse coal that is the dried coal C302 and the fine coal C303 while drying the coal C301, and the fine coal C303 is supplied to the combustor 311.

(29) The coal reforming apparatus 410 described in (28) may be configured so that at least a portion of the flue gas G302 discharged from the fluidized bed drying and classifying device 351 is mixed with the heating gas G301 supplied to the fluidized bed drying and classifying device 351 as the heat source.

(30) The coal reforming apparatus 410 described in (28) or (29) may employ a configuration in which at least a portion of the fine coal C303 obtained by the fluidized bed drying and classifying device 351 is supplied to the carbonizing device 303.

(31) The coal reforming apparatus 410 described in (30) may further include the forming machine which forms the fine coal C303 singly or together with the dried coal C302, and may employ a configuration in which at least a portion of the fine coal C303 obtained by the fluidized bed drying and classifying device 351 is supplied to the carbonizing device 303 after being formed singly or together with the dried coal C302 by the forming machine.

(32) In the coal reforming apparatus described in any one of (24) to (31), instead of the carbonizing gas D301 among the fine char C306 and the carbonizing gas D301 which are supplied to the combustor 311, the external fuel may be used.

As described above, according to the second and third embodiments, the fluidized bed cooling and classifying device 307 is employed as the cooler which is used to reform the coal, and the fine char C306 obtained by the fluidized bed cooling and classifying device 307 is used as the fuel. Accordingly, the reformation of the coal C301 can be more efficiently performed.

Examples

The coal reforming method and the coal reforming apparatus of the present invention can also perform the coal reforming process without use of an additional external fuel, and as a result, improvement in manufacturing efficiency is realized. Hereinafter, in order to confirm this point, Examples 7 to 9 and Comparative Example 3 are described.

Example 7

Example 7 corresponds to the first embodiment described with reference to FIG. 1.

In Example 7, the coal C1 (having a moisture content of 60%) which was coarsely crushed and had the particle size distribution illustrated in the above Table 1 was injected into the fluidized bed drying and classifying device 101 at 560 kg/h (240 kg/h excluding moisture), and was dried in the fluidized bed drying and classifying device 101 by using the heating gas G1 at 230° C. and 2800 $Nm^3$/h until the moisture content became 10%.

The temperature of the obtained dried coal C2 was increased to 600° C. in the carbonizing device 103 which was the external heating type rotary kiln for carbonizing. As a result, char at 132 kg/h, gas (gas that mainly contained CO, $H_2$, and $CH_4$ and had a heating value of 3450 kcal/$Nm^3$) at 67 $Nm^3$/h, and tar at 18.7 kg/h could be obtained, and the obtained total amount (the total amount of the gas and the tar generated in the carbonizing device 103 excluding a product char) was transported to the combustor 109 and was burned to generate the combustion gas G3 at 1500° C.

The dried fine coal C3 at 6 kg/h among the dried fine coal C3 at 15 kg/h recovered by the fluidized bed drying and classifying device 101 was simultaneously burned in the combustor 109. The remaining dried fine coal C3 at 9 kg/h was subjected to compression molding by the molding machine (not illustrated) provided in the pipe L3 of FIG. 1, and the result was then injected into the carbonizing device 103.

As a result, it was confirmed that the recovery amount (recovery rate) of the char was increased, the amount of fine particles in the recovered char was smaller than that in Comparative Example 3, and the amount of dust emitted from the char was small. In Example 7, the heating gas G1 was cooled by being mixed with the flue gas from the dust collector 105 by using the pipe L1 illustrated in FIG. 1.

Example 8

Example 8 corresponds to the second embodiment which is described with reference to FIG. 4.

In Example 8, the coal C301 (having a moisture content of 60%) which was coarsely crushed and had the particle size distribution illustrated in the above Table 2 was injected into the indirect heating type dryer 301 having the steam tube type at 600 kg/h (240 kg/h excluding moisture), and was dried until the moisture content became 10%.

The temperature of the obtained dried coal C302 was increased to 600° C. in the carbonizing device 303 using the external heating type rotary kiln for carbonizing. As a result, char at 132 kg/h, gas (gas that mainly contained CO, $H_2$, and $CH_4$ and had a heating value of 3450 kcal/$Nm^3$) at 69 $Nm^3$/h, and tar at 19 kg/h could be obtained, and the obtained total amount of the gas and the tar was transported to the combustor 311 and was burned to generate the combustion gas at 1500° C. (the amount of the char which had scattered along with the gas or the tar from the carbonizing device 303 was estimated to be about 6 kg/h).

In addition to the volatile components, the fine char C306 at 3 kg/h recovered by the fluidized bed cooling and classifying device 307 was simultaneously burned in the combustor 311. In Example 8, the amount of the char C305 finally recovered as a product was 129 kg/h. In addition, in Example 8, the combustion gas 6303 was cooled by being mixed with a portion of the flue gas by using the pipe L301 illustrated in FIG. 4.

Example 9

Example 9 corresponds to the third embodiment which is described with reference to FIG. 7.

In Example 9, the coal C301 (having a moisture content of 60%) which was coarsely crushed and had the particle size distribution illustrated in the above Table 2 was injected into the fluidized bed drying and classifying device 351 at 560 kg/h (240 kg/h excluding moisture), and was dried in the fluidized bed drying and classifying device 351 by using the heating gas G301 at 230° C. and 2800 $Nm^3$/h until the moisture content became 10%.

The temperature of the obtained dried coal C302 was increased to 600° C. in the carbonizing device 303 using the external heating type rotary kiln for carbonizing. As a result, char at 136 kg/h, gas (gas that mainly contained CO, $H_2$, and $CH_4$ and had a heating value of 3450 kcal/$Nm^3$) at 68 $Nm^3$/h, and tar at 19 kg/h could be obtained, and the obtained total amount of the gas and the tar was transported to the combustor 311 to obtain the combustion gas G303 at 1500° C. In addition to the volatile components, the dried fine coal C303 at 7 kg/h recovered by the fluidized bed drying and classifying device 351 and the fine char C306 at 2 kg/h recovered by the fluidized bed cooling and classifying device 307 were simultaneously burned in the combustor 311. In Example 9, the amount of the char C305 finally recovered as a product was 134 kg/h, and thus the recovery amount (recovery rate) of the char was increased.

In addition, in Example 9, 8 kg of the fine coal C303 among 15 kg of the fine coal C303 recovered in the fluidized bed drying and classifying device 351 was injected into the carbonizing device 303 by using the pipe L304 illustrated in FIG. 7 after being subjected to the compression molding by a molding machine (not illustrated), and the combustion gas G303 was cooled by being mixed with a portion of the flue gas using the pipe L301 illustrated in FIG. 7. When the inside of the pipe from the carbonizing device 303 to the combustor 311 was inspected after the operation, dust adhesion had rarely occurred, and carryover had rarely occurred.

Comparative Example 3

Coal (having a moisture content of 60%) which was coarsely crushed and had the particle size distribution illustrated in the above Table 1 was injected into a steam tube type dryer at 600 kg/h, and was dried until the moisture content became 10%.

The temperature of the obtained dried coal was increased to 600° C. in the carbonizing device which was the external heating type rotary kiln for carbonizing. As a result, char at 139 kg/h, gas (gas that mainly contained CO, $H_2$, and $CH_4$ and had a heating value of 3450 kcal/$Nm^3$) at 69 $Nm^3$/h, and tar at 19 kg/h could be obtained, and the obtained total amount of the gas and the tar and the scattered char at 7 kg/h were burned in the combustor to obtain the combustion gas at 1500° C.

In Comparative Example 3, a necessary heating value for the dryer and the carbonizing device could not be provided, and thus heavy oil at 17 kg/h was supplied to the combustor and was burned to secure a necessary heating value for the treatments. As described above, in a case where dried fine coal from the fluidized bed drying and classifying device was not used, heavy oil at 17 kg/h was needed.

When the inside of the pipe from the carbonizing device to the combustor was inspected after the operation, it was seen that dust adhesion had occurred (particularly significantly in bent portions), and carryover had occurred. Furthermore, combustor outlet gas was sampled, and unreacted solid particles were measured. Therefore, there is concern that the pipe may be clogged during an operation over a long period of time.

The collection of the results of Examples 7 to 9 and Comparative Example 3 described above is listed in Table 3. As can be seen from Table 3, a result that the manufacturing efficiencies of Examples 7 to 9 are improved by about 7% to 10% compared to Comparative Example 3 was obtained. Generally, it is difficult to improve the thermal efficiency (manufacturing efficiency) by several percent. However, in Examples 7 to 9 to which the present invention is applied, a significant improvement in the thermal efficiency was confirmed.

While the exemplary embodiments and modification examples of the present invention have been described in detail with reference to the accompanying drawings, the present invention is not construed as being limited only to the examples. It is apparent that various modification examples or correction examples can be made by those skilled who have knowledge in the technical field to which the present invention belongs, without departing from the technical spirit described in the appended claims, and it is understood that the examples naturally belong to the technical scope of the present invention.

INDUSTRIAL APPLICABILITY

According to the present invention, a coal reforming method and a coal reforming apparatus capable of reforming coal more efficiently even in a case where components derived from coal are used as external fuels used for a reforming treatment can be provided.

BRIEF DESCRIPTION OF THE REFERENCE SYMBOLS

10, 310, 310A, 410, 410A: COAL REFORMING APPARATUS

101, 351: FLUIDIZED BED DRYING AND CLASSIFYING DEVICE

103, 303: CARBONIZING DEVICE

105, 309, 353: DUST COLLECTOR

107: COOLER

109, 311: COMBUSTOR

301: DRYER

305: BOILER

307: FLUIDIZED BED COOLING AND CLASSIFYING DEVICE

TABLE 3

| Item | | | Example 7 | Example 8 | Example 9 | Comparative Example 3 |
|---|---|---|---|---|---|---|
| Raw material coal | Charge amount | kg-wet | 560 | 600 | 560 | 600 |
| | Moisture content | wt % | 60 | 60 | 60 | 60 |
| Heating gas | Flow rate | $Nm^3$/h | 2800 | — | 2800 | — |
| | Temperature | ° C. | 230 | — | 230 | — |
| Classification and combustion of dried fine coal | | — | Presence | Absence | Presence | Absence |
| Molding and granulating of dried fine coal | | — | Presence | Absence | Presence | Absence |
| Classification and combustion of fine char | | — | Absence | Presence | Presence | Absence |
| Presence or absence of carryover | | — | Absence | Presence | Absence | Presence |
| Presence or absence of external fuel | | — | Absence | Absence | Absence | Presence |
| Recovery amount of coal material | | kg | 134 | 129 | 134 | 132 |
| Manufacturing efficiency (*) | | % | 74.4 | 71.6 | 74.4 | 65.0 |
| Improvement in manufacturing efficiency compared to Comparative Example 1 | | | 9.4 | 6.6 | 9.4 | — |

(*) Manufacturing efficiency (%) = (Heating value of product coal/(Heating value of the amount of injected coal + Heating value of external fuel) × 100

The invention claimed is:

1. A coal reforming method comprising:

classifying a coal into a coarse coal and a fine coal while drying the coal in a fluidized bed drying and classifying device;

performing carbonizing on the coarse coal, by a carbonizing device, so as to reform the coarse coal into a carbonizing gas and a char;

obtaining a heat by supplying at least a portion of the carbonizing gas or an external fuel, and at least a portion of the fine coal, to a combustor and burning the portions; and supplying the heat obtained by burning the portions to at least one of the fluidized bed drying and classifying device and the carbonizing device as a heat source.

2. The coal reforming method according to claim 1, further comprising:

mixing at least a portion of a flue gas discharged from the fluidized bed drying and classifying device with a combustion gas supplied from the combustor to the at least one of the fluidized bed drying and classifying device and the carbonizing device.

3. The coal reforming method according to claim 1, further comprising:

supplying a further portion of the fine coal obtained by the fluidized bed drying and classifying device to the carbonizing device.

4. The coal reforming method according to claim 3, wherein the further portion of the fine coal supplied to the carbonizing device is supplied to the carbonizing device after being formed singly or together with the coarse coal.

5. The coal reforming method according to claim 1, wherein the carbonizing device is of an indirect heating type which is supplied with a heating gas from an outside source, wherein the heating gas from the outside source is selected from the group consisting of a combustion gas discharged from the combustor, a gas obtained by mixing the combustion gas with another gas, a gas obtained by supplying the combustion gas to a heat exchanger, and a gas manufactured by using the external fuel, and wherein the coal reforming method further includes supplying a heating gas discharged from the carbonizing device to the fluidized bed drying and classifying device.

6. The coal reforming method according to claim 1, further comprising:

mixing at least a portion of a flue gas discharged from the fluidized bed drying and classifying device with a heating gas supplied to the fluidized bed drying and classifying device.

7. The coal reforming method according to claim 1, further comprising:

supplying a gas, which is discharged from the carbonizing device and is different from the carbonizing gas, to the fluidized bed drying and classifying device as a heating gas; and controlling a flow rate of the heating gas, which is a fluidizing gas supplied to the fluidized bed drying and classifying device, based on a moisture content of the coarse coal at an outlet of the fluidized bed drying and classifying device.

8. A coal reforming apparatus comprising:

a fluidized bed drying and classifying device which classifies a coal into a coarse coal and a fine coal while drying the coal;

a carbonizing device which performs carbonizing on the dried coarse coal, so as to reform said dried coarse coal into a carbonizing gas and a char; and a combustor which is supplied with at least a portion of the carbonizing gas or an external fuel, and at least a portion of the fine coal and which supplies a heat, obtained by burning the carbonizing gas or the external fuel and the portion of the fine coal, to at least one of the fluidized bed drying and classifying device and the carbonizing device as a heat source.

9. The coal reforming apparatus according to claim 8, wherein at least a portion of a flue gas discharged from the fluidized bed drying and classifying device is mixed with a combustion gas supplied from the combustor to the at least one of the fluidized bed drying and classifying device and the carbonizing device as the heat source.

10. The coal reforming apparatus according to claim 8, wherein a further portion of the fine coal obtained by the fluidized bed drying and classifying device is supplied to the carbonizing device.

11. The coal reforming apparatus according to claim 10, further comprising:

a forming machine which forms the fine coal singly or together with the coarse coal, wherein the further portion of the fine coal obtained by the fluidized bed drying and classifying device is supplied to the carbonizing device after being formed singly or together with the coarse coal by the forming machine.

12. The coal reforming apparatus according to claim 8, wherein the carbonizing device is of an indirect heating type which is supplied with a heating gas from an outside source, wherein the heating gas from the outside source is selected from the group consisting of a combustion gas discharged from the combustor, a gas obtained by mixing the combustion gas with another gas, a gas obtained by supplying the combustion gas to a heat exchanger, and a gas manufactured by using the external fuel, and wherein a heating gas discharged from the carbonizing device is supplied to the fluidized bed drying and classifying device.

13. The coal reforming apparatus according to claim 8, wherein at least a portion of a flue gas discharged from the fluidized bed drying and classifying device is mixed with a heating gas supplied to the fluidized bed drying and classifying device as the heat source.

14. The coal reforming apparatus according to claim 8, further comprising:

a controller, wherein the carbonizing device supplies a gas, which is different from the carbonizing gas, to the fluidized bed drying and classifying device as a heating gas, and the controller identifies a moisture content of the coarse coal at an outlet of the fluidized bed drying and classifying device, and controls a flow rate of the heating gas, which is a fluidizing gas supplied to the fluidized bed drying and classifying device, based on the moisture content of the coarse coal.

15. A coal reforming method comprising:

drying a coal by a dryer;

performing carbonizing on the dried coal by a carbonizing device, so as to reform the dried coal into a carbonizing gas and a char;

classifying the char while cooling the char by a fluidized bed cooling and classifying device to separate a fine char from the char;

obtaining a heat by supplying at least a portion of the carbonizing gas or an external fuel, and at least a portion of the fine char, to a combustor and burning the portions; and supplying the heat obtained by burning the portions to at least one of the dryer and the carbonizing device as a heat source.

16. The coal reforming method according to claim 15, further comprising:

supplying a flue gas discharged from the at least one of the dryer and the fluidized bed cooling and classifying device to the fluidized bed cooling and classifying device as a cooling gas.

17. The coal reforming method according to claim 15, further comprising:

mixing at least a portion of a flue gas discharged from the dryer with a combustion gas supplied from the combustor to the at least one of the dryer and the carbonizing device.

18. The coal reforming method according to claim 15, wherein the carbonizing device is of an indirect heating type which is supplied with a heating gas from an outside source, wherein the heating gas from the outside source is selected from the group consisting of a combustion gas discharged from the combustor, a gas obtained by mixing the combustion as with another gas, a gas obtained by supplying the combustion gas to a heat exchanger, and a gas manufactured by using the external fuel, and wherein the coal reforming method further includes supplying a heating gas discharged from the carbonizing device to the dryer.

19. The coal reforming method according to claim 15, further comprising:

classifying the coal into a coarse coal and a fine coal while drying the coal by using a fluidized bed drying and classifying device as the dryer in the step of drying of the coal by the dryer; and supplying the fine coal to the combustor.

20. The coal reforming method according to claim 19, further comprising:

mixing at least a portion of a flue gas discharged from the fluidized bed drying and classifying device with a heating gas supplied to the fluidized bed drying and classifying device as the heat source.

21. The coal reforming method according to claim 19, further comprising:

supplying at least a portion of the fine coal obtained by the fluidized bed drying and classifying device to the carbonizing device.

22. The coal reforming method according to claim 21, wherein the at least a portion of the fine coal obtained by the fluidized bed drying and classifying device is supplied to the carbonizing device after being formed singly or together with the coarse coal.

23. The coal reforming method according to claim 15, further comprising:

supplying a cooling gas to the fluidized bed cooling and classifying device; and controlling a flow rate of the cooling gas, which is a fluidizing gas supplied to the fluidized bed cooling and classifying device, based on a moisture content of the dried coal at an outlet of the dryer.

24. A coal reforming apparatus comprising:

a dryer which dries a coal;

a carbonizing device which performs carbonizing on the dried coal, so as to reform said dried coal into a carbonizing gas and a char;

a fluidized bed cooling and classifying device which classifies the char while cooling the char to separate a fine char from the char; and a combustor, which is supplied with at least a portion of the carbonizing gas or an external fuel, and at least a portion of the fine char, and which supplies a heat, obtained by burning the carbonizing gas or the external fuel and the portion of the fine char, to at least one of the dryer and the carbonizing device as a heat source.

25. The coal reforming apparatus according to claim 24, wherein a flue gas discharged from the at least one of the dryer and the fluidized bed cooling and classifying device is supplied to the fluidized bed cooling and classifying device as a cooling gas.

26. The coal reforming apparatus according to claim 24, wherein at least a portion of a flue gas discharged from the dryer is mixed with a combustion gas supplied from the combustor to the at least one of the dryer and the carbonizing device as the heat source.

27. The coal reforming apparatus according to claim 24, wherein the carbonizing device is of an indirect heating type which is supplied with a heating gas from an outside source, wherein the heating gas from the outside source is selected from the group consisting of a combustion gas discharged from the combustor, a gas obtained by mixing the combustion gas with another gas, a gas obtained by supplying the combustion gas to a heat exchanger, and a gas manufactured by using the external fuel, and wherein a heating gas discharged from the carbonizing device is supplied to the dryer.

28. The coal reforming apparatus according to claim 24, wherein the dryer is a fluidized bed drying and classifying device which classifies the coal into a coarse coal and a fine coal while drying the coal, and the fine coal is supplied to the combustor.

29. The coal reforming apparatus according to claim 28, wherein at least a portion of a flue gas discharged from the fluidized bed drying and classifying device is mixed with a heating gas supplied to the fluidized bed drying and classifying device as the heat source.

30. The coal reforming apparatus according to claim 28, wherein at least a portion of the fine coal obtained by the fluidized bed drying and classifying device is supplied to the carbonizing device.

31. The coal reforming apparatus according to claim 30, further comprising:

a forming machine which forms the fine coal singly or together with the coarse coal, wherein the at least a portion of the fine coal obtained by the fluidized bed drying and classifying device is supplied to the carbonizing device after being formed singly or together with the coarse coal by the forming machine.

32. The coal reforming apparatus according to claim 24, further comprising:

a controller, wherein the fluidized bed cooling and classifying device classifies the char while cooling the char by using a cooling gas supplied from the other device, to separate the fine char from the char, and the controller identifies a moisture content of the dried coal at an outlet of the dryer, and controls a flow rate of the cooling gas, which is a fluidizing gas supplied to the fluidized bed cooling and classifying device, based on the moisture content of the dried coal.

* * * * *